US008655213B2

(12) United States Patent
Tanaka et al.

(10) Patent No.: US 8,655,213 B2
(45) Date of Patent: Feb. 18, 2014

(54) IMAGE HEATING DEVICE AND IMAGE FORMING APPARATUS

(75) Inventors: Masanobu Tanaka, Toride (JP); Kazuaki Ono, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 250 days.

(21) Appl. No.: 13/154,741

(22) Filed: Jun. 7, 2011

(65) Prior Publication Data

US 2011/0305474 A1 Dec. 15, 2011

(30) Foreign Application Priority Data

Jun. 15, 2010 (JP) ..... 2010-136200

(51) Int. Cl.
*G03G 15/20* (2006.01)

(52) U.S. Cl.
USPC ..... 399/69; 399/328; 399/329

(58) Field of Classification Search
USPC ..... 399/69, 329, 330, 334
See application file for complete search history.

(56) References Cited

U.S. PATENT DOCUMENTS

| | | | | |
|---|---|---|---|---|
| 7,302,223 | B2 | 11/2007 | Kawashima | |
| 7,319,839 | B2 | 1/2008 | Ishii et al. | |
| 7,577,389 | B2 | 8/2009 | Ishii et al. | |
| 7,650,105 | B2 | 1/2010 | Ogawa et al. | |
| 7,668,500 | B2 | 2/2010 | Kawashima | |
| 7,684,746 | B2 * | 3/2010 | Asakura et al. | 399/330 |
| 7,783,219 | B2 * | 8/2010 | Maeda | 399/69 |
| 8,532,530 | B2 | 9/2013 | Nishida et al. | |
| 2002/0027134 | A1 * | 3/2002 | Nakayama et al. | 219/619 |
| 2004/0264991 | A1 | 12/2004 | Yoshikawa | |
| 2005/0117942 | A1 | 6/2005 | Ishii et al. | |
| 2005/0141936 | A1 | 6/2005 | Kawashima | |
| 2007/0000899 | A1 | 1/2007 | Tsunoda | |
| 2007/0212093 | A1 * | 9/2007 | Maeda et al. | 399/69 |
| 2008/0003009 | A1 | 1/2008 | Minakuchi et al. | |
| 2008/0044210 | A1 | 2/2008 | Kawashima | |
| 2008/0080911 | A1 | 4/2008 | Ishii et al. | |

(Continued)

FOREIGN PATENT DOCUMENTS

| | | |
|---|---|---|
| JP | 2004-198659 | 7/2004 |
| JP | 2005-189427 | 7/2005 |

OTHER PUBLICATIONS

British Search Report dated Oct. 3, 2011, in counterpart Great Britain Application No. GB1110044.3.

(Continued)

*Primary Examiner* — David Gray
*Assistant Examiner* — Francis Gray
(74) *Attorney, Agent, or Firm* — Fitzpatrick, Cella, Harper & Scinto

(57) ABSTRACT

An image heating device includes: a rotatable heater for heating an image on a recording material; a pressor for pressing the heater to form a nip in which the recording material is to be nip-conveyed; a belt for heating and contacting the heater; a first member for heating the belt while pressing the belt against the heater; a second member, provided downstream of the first member with respect to a rotational direction of the heater, for heating the belt while pressing the belt against the heater; a first portion for heating the first member by energization; and a second portion for heating the second member by energization. Each of the first and second portions is supplied with power so that a maximum of the power supplied to the first means is smaller than that of the power supplied to the second portion.

20 Claims, 10 Drawing Sheets

(56) References Cited

U.S. PATENT DOCUMENTS

| | | | | |
|---|---|---|---|---|
| 2009/0290888 | A1 | 11/2009 | Mukai | |
| 2009/0297201 | A1* | 12/2009 | Ono | 399/88 |
| 2010/0135706 | A1 | 6/2010 | Miki et al. | |
| 2010/0196039 | A1* | 8/2010 | Ono | 399/69 |

OTHER PUBLICATIONS

Chinese Office Action dated Aug. 16, 2013, in counterpart Chinese Application No. 201110160220.7, and English-language translation thereof.

* cited by examiner

IMAGE HEATING DEVICE AND IMAGE FORMING APPARATUS

FIELD OF THE INVENTION AND RELATED ART

The present invention relates to an image heating device for heat-fixing an image, on a recording material, which is formed on the recording material at an image forming portion, and an image forming apparatus (a copying machine, a printer, a multi-function machine, a facsimile machine, etc.) of an electrophotographic type including the image heating device.

In recent years, the image forming apparatus such as the copying machine, the printer or the multi-function machine is required to realize further improvements in speed-up, image quality, color quality, energy saving and the like. In addition, the image forming apparatus is also required to realize multimedia compatibility with various recording materials such as thin paper, thick paper, roughened paper (rough surface paper), uneven paper (embossed paper or the like) and coated paper (gloss coated paper, matt coated paper or the like) and to realize high productivity (a large number of sheets subjected to image formation per unit time). Particularly, in order to enhance the productivity of the recording material, having a large basis weight, such as thick paper, there is a need to improve a fixing property, such that a toner image is fixed on the recording material, by improving a recording-material heating property of a fixing device as the image heating device.

However, the heat quantity necessary to fix the toner image on a recording material (thick paper) having a large basis weight is considerably larger than that of a recording material (thin paper) having a small basis weight. For this reason, when the toner (image) fixing on the recording material having the large basis weight is effected at the same fixing speed as that in the case of the recording material having the small basis weight, there is a possibility that a substantial amount of heat of an image heating member of the fixing device for heating the toner can be stolen and the surface temperature is lowered to cause improper fixing. Therefore, when the toner is fixed on the recording material having the large basis weight, in order to ensure the fixing property (a bonding strength between the toner and the recording material), it is the current status of image forming apparatuses that a fixing process is effected by lowering the fixing speed, i.e., the productivity.

As such an image heating device, e.g., a fixing roller is generally used, having a heat-resistant elastic layer of silicone rubber, a fluorine-containing rubber or the like coated on a pipe-like metal core containing therein a heating means, such as a halogen heater, and then a parting layer of a fluorine-containing resin material is formed on the elastic layer. With respect to such a fixing roller, the heat from the halogen heater is less liable to be transferred to the surface of the fixing roller by being blocked by the metal core and the elastic layer having low thermo-conductivity. This constitutes one of factors causing the lowering in surface temperature.

Incidentally, there is also a structure in which the elastic layer is not provided in the fixing roller. In the case of this structure, correspondingly to the absence of the elastic layer, the degree of the surface temperature lowering is small, but the heat is blocked with an increase in thickness of the metal core and the surface temperature lowering occurs similarly. Further, in the case where there is no elastic layer, with respect to a recording material having large recesses and projection, there is a possibility that the toner in the recesses is not readily contacted to the fixing roller and is not properly fixed. Particularly, with respect to a color (toner) image, there is a possibility that the surface of an unfixed image cannot be melted uniformly to cause fixing non-uniformity, uneven glossiness and color unevenness, and thus an image quality is lowered. Therefore, from the viewpoints of compatibility with various recording materials and the image quality, in the fixing roller, it is suitable to coat the elastic layer on the metal core.

In either case, in order to prevent the surface temperature lowering of the fixing roller, it would be considered to use a structure such that a high-power halogen heater is disposed in the fixing roller to abruptly heat the fixing roller. However, in the case of this structure, a metal core temperature is abruptly increased, so that there is a possibility of an occurrence of separation between the metal core and the elastic layer or separation between the metal core and the parting layer due to heat deterioration of an adhesive layer between the metal core and the elastic layer or heat deterioration of an adhesive layer between the metal core and the parting layer. Further, the elastic layer is thermally softening-deteriorated or hardening-deteriorated to cause a large change in hardness of the fixing roller so that there is also a possibility that the fixing property fluctuates with a change in width of a fixing nip between the fixing roller and a pressing roller as a pressing member or that the softening deterioration proceeds and the elastic layer is broken.

Therefore, in order to prevent the surface temperature lowering of the fixing roller, as a technique for improving the heating property and the productivity, a fixing device for heating the fixing roller not only from the inside heater but also from an outside of the fixing roller by bringing a belt member into contact to the fixing roller has been proposed (Japanese Laid-Open Patent Application No. (JP-A) 2004-198659 and JP-A 2005-189427). In the case of the fixing device described in these documents, any of a plurality of stretching rollers for stretching the belt member contains a halogen heater as a heating means. Heat of this halogen heater is transferred via the stretching roller containing the halogen heater to the belt member and then is transferred to the fixing roller surface, so that the surface temperature of the fixing roller is prevented from being lowered.

However, of the structures described in these documents, in the case of the structure including the heating means at a position upstream adjacent to a contact portion (external heat-contact portion) between the belt member and the fixing roller, the following problem arises at some setting of electric power for the heating means.

That is, in order to effect energization control of the heating means for heating the belt member, in the case where the heating means is disposed at a portion, to be heated by the heating means, e.g., inside the stretching roller, the energization control may preferably be effected by detecting the temperature of the belt member, stretched by the stretching rollers, at an outer peripheral surface portion of the belt member. However, the portion to be heated by the heating means upstream of the external heat-contact portion is located before a power in which the heat of the belt member is taken by the fixing roller, and therefore its temperature tends to reach a set temperature in a short time by the heating with the upstream heating means. In other words, the time of energization to the upstream heating means becomes short. Particularly, when the heat-generation amount of the upstream heating means is large, the energization time is further shortened, so that the portion to be heated is increased in temperature in a further short time. As a result, at a portion where a gradient of the temperature rise with time is large, compared with other portions, temperature non-uniformity is liable to occur.

When the temperature non-uniformity with an abrupt temperature rise gradient occurs immediately before the external heat-contact portion, the fixing roller is heated at the external heat-contact portion in a state in which the temperature non-uniformity occurs, so that the temperature non-uniformity is transferred to the fixing roller. As a result, there is a possibility that the fixing non-uniformity, the uneven glossiness, the color unevenness, and the like occur to lower the image quality. That is, at the portion where the surface temperature of the fixing roller is abruptly changed, image heating non-uniformity is liable to occur.

Incidentally, even when the time of energization to the heating means disposed at a position downstream of the external heat-contact portion is short, the degree of the temperature non-uniformity is decreased by conformability during rotation of the belt member, so that the temperature non-uniformity transferred to the fixing roller is suppressed. However, a portion to be heated by the heating means downstream of the external heat-contact portion is located at a position immediately after the heat of the belt member is taken by the fixing roller at the external heat-contact portion and therefore even when the portion to be heated by the downstream heating means, the temperature of the portion is not readily increased and thus a time until the temperature of the portion reaches a set temperature is liable to become long.

SUMMARY OF THE INVENTION

A principal object of the present invention is to provide an image heating device capable of reducing the occurrence of image heating non-uniformity by suppressing temperature non-uniformity at an upstream position of an external heat-contact portion of a belt member.

Another object of the present invention is to provide an image forming apparatus including the image heating device.

According to an aspect of the present invention, there is provided an image heating device comprising:

a rotatable image heating member for heating an image on a recording material;

a pressing member for pressing the image heating member to form a nip in which the recording material is to be nip-conveyed;

a belt member for heating the image heating member in contact with the image heating member;

a first belt heating member for heating the belt member while pressing the belt against the image heating member;

a second belt heating member, provided downstream of the first belt heating member with respect to a rotational direction of the image heating member, for heating the belt member while pressing the belt member against the image heating member;

first heating means for heating the first belt heating member by energization; and second heating means for heating the second belt heating member by energization, wherein each of the first heating means and the second heating means is supplied with power so that a maximum of the power supplied to the first heating means is smaller than that of the power supplied to the second heating means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

First Embodiment

Figure 1:
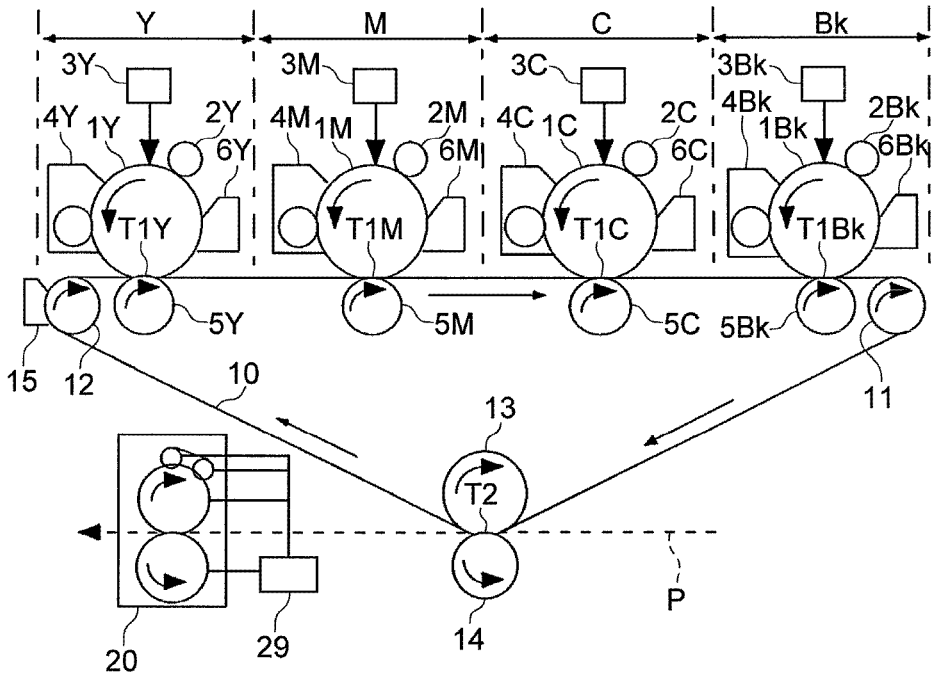
FIG. 1 is a schematic illustration of an image forming apparatus according to First Embodiment of the present invention.

First, referring to FIGS. 1-12, a first embodiment of the present invention will be described. First, referring to FIG. 1, an image forming apparatus in this embodiment will be described. In the image forming apparatus shown in FIG. 1, four image forming unit Y (yellow), M (magenta), C (cyan) and Bk (black) for forming four toner images different in color from each other are disposed. An endless intermediary transfer belt 10 as an intermediary transfer member is disposed so as to extend along these image forming units.

These four image forming units Y, M, C and Bk have the same constitution (structure). In the following, the structure of the yellow image forming unit Y will be described as the image forming unit which represents the four image forming units. With respect to other image forming units, members which are the same in structure and function, as those for the yellow image forming unit Y, are represented by the same reference numerals or symbols, and suffixes indicating the respective units are used by changing the suffix Y thereto.

As an image bearing member, a cylindrical electrophotographic photosensitive member (which hereafter referred to as a photosensitive drum) 1Y, which has a surface layer formed of, e.g., an OPC (organic photosensitive semiconductor), is rotationally driven in the direction indicated by an arrow. A reference symbol 2Y denotes a charging roller for uniformly charging the surface of the photosensitive drum 1Y. The charging roller 2Y to which a predetermined bias is applied charges the surface of the photosensitive drum 1Y to a predetermined potential while being rotated by the rotation of the photosensitive drum 1Y in contact with the photosensitive drum 1. The charged photosensitive drum 1Y is exposed to exposure light (laser light, etc.) by an exposure device 3Y, so that an electrostatic latent image corresponding to a color-separation image of an input original is formed. A developing device 4Y develops the electrostatic latent image with toner charged by its developing roller, so that a toner image corresponding to the electrostatic latent image is formed on the surface of the photosensitive drum 1Y. The toner image on the photosensitive drum 1Y is primary-transferred, by a primary transfer roller 5Y, onto the intermediary transfer belt 10 which rotates at the substantially same speed as a peripheral speed of the photosensitive drum 1Y.

Primary transfer residual toner on the photosensitive drum 1Y after the primary transfer is collected by a photosensitive drum cleaning device 6Y, which is provided with a blade, a brush or the like. Then, the photosensitive drum 1 from which the primary transfer residual toner is removed is uniformly charged again by the charging roller 2Y, and is repetitively subjected to image formation.

The intermediary transfer belt 10 is stretched by a driving roller 11, a supporting roller 12 and a back-up roller 13. The intermediary transfer belt 10 is rotationally driven by the rotation of the driving roller 11 in the direction indicated by an arrow while being contacted to the four photosensitive drums 1Y, 1M, 1C and 1K of the image forming units Y, M, C and K.

In the case where the full-color mode (full-color image formation) is selected, an image forming operation as described above is carried out by each of the four image forming units Y, M, C and Bk. Then, yellow, magenta, cyan and black toner images formed on the photosensitive drum 1Y, 1M, 1C and 1Bk, respectively are successively transferred superposedly onto the intermediary transfer belt 10. Incidentally, the order in which the four color toner images are formed is not limited but is optional depending on the image forming apparatus.

Then, the four color toner images superposedly transferred onto the intermediary transfer belt 10 are secondary-transferred collectively onto a recording material P of recording medium, by a secondary transfer roller 14, at a second transfer portion T2 between the back-up roller 13 and the secondary transfer roller 14. Further, the recording material P is separated and fed from a sheet feeding cassette (unshown) one by one, and then is conveyed further by a registration roller pair (unshown) with predetermined timing that each sheet reaches the second transfer portion T2 at the same time as the superposed and transferred toner images.

In this embodiment, the image forming portion for forming an image on the recording material P of is constituted as described above. Then the images (toner images) formed on the recording material P by such an image forming portion are fixed on the recording material P by a fixing device 20 as the image heating device. That is, the recording material P on which the toner images are transferred is introduced into the fixing device 20 and the toner images on the recording material P are pressed and heated, so that the full-color toner image is heat-fixed on the recording material P.

Secondary transfer residual toner on the intermediary transfer belt 10 after the secondary transfer is collected by an intermediary transfer belt cleaning device 15 provided with a blade, a brush or the like. Then, the intermediary transfer belt 10 from which the secondary transfer residual toner is removed is repetitively subjected to the primary transfer for subsequent image formation.

Further, in the case of a monochromatic color mode (monocolor image formation) of, e.g., black or a mode of two or three colors, the image formation on the photosensitive drum(s) is effected by the image forming unit(s) of necessary color(s). At this time, the remaining (one to three) photosensitive drums of unnecessary image forming unit(s) are idled. Further, such an operation that the resultant toner image(s) is (are) primary-transferred onto the intermediary transfer belt 10 at the primary transfer portion T1 and is (are) secondary-transferred onto the recording material P at the secondary transfer portion T2 and then is (are) introduced into the fixing device 20 is executed.

Figure 2:
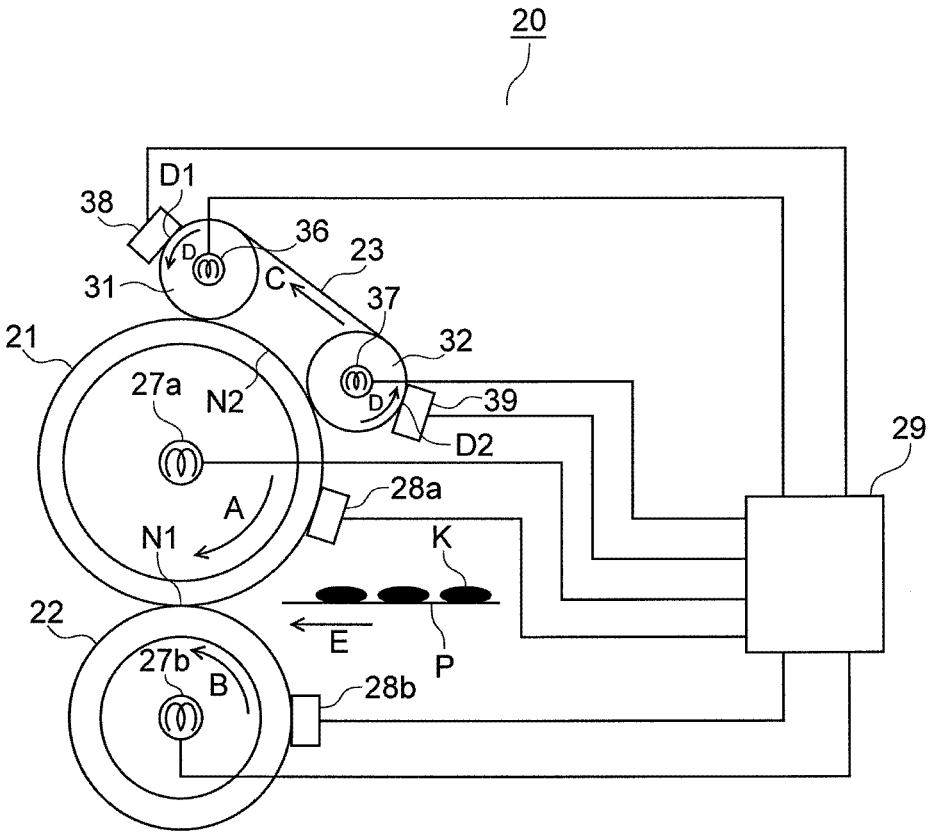
FIG. 2 is a schematic illustration of a fixing device according to First Embodiment.

Next, the fixing device 20 will be described. As shown in FIG. 2, the fixing device 20 includes a fixing roller 21 which is a rotatable image heating member, a pressing roller 22 which is a pressing member, and a belt member 23 constituting an external heating member. Of these, the fixing roller 21 is rotationally driven by an unshown driving source in an arrow A direction at a predetermined speed, e.g., at a peripheral speed of 500 mm/sec. Further, the pressing roller 22 is rotated by the rotation of the fixing roller 21.

Figure 3:
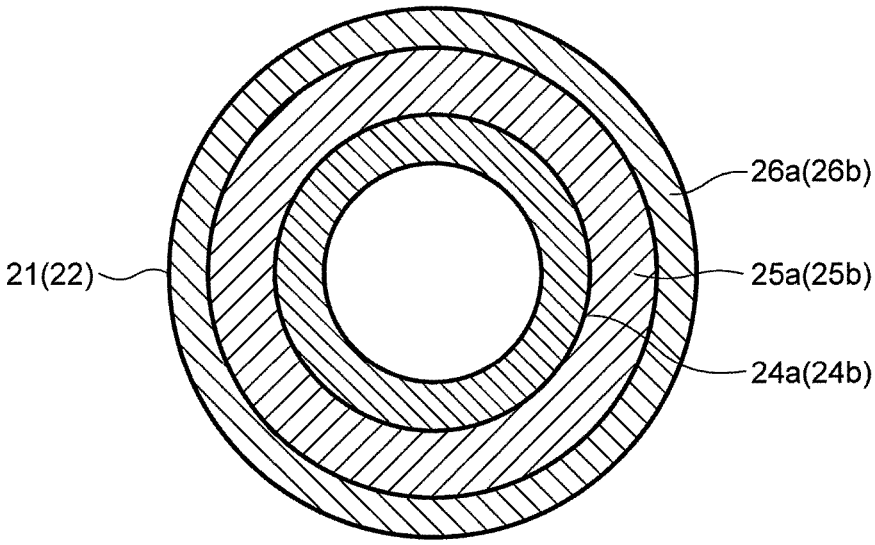
FIG. 3 is a schematic sectional illustration of a fixing roller and a pressing roller.

Such a fixing roller 21 and a pressing roller 22 are, as shown in FIG. 3, prepared by superposing, from an inner diameter (portion) side, cylindrical metal cores 24*a* and 24*b*, heat-resistant elastic layers 25*a* and 25*b* and heat-resistant parting layers 26*a* and 26*b*. The metal core 24*a* of the fixing roller 21 is, e.g., formed of aluminum with 74 mm in outer diameter, 6 mm in thickness and 350 mm in length. Further, the elastic layer 25*a* is formed of, e.g., 3 mm-thick silicone rubber (e.g., JIS-A hardness of 20 degrees) and coats an outer peripheral surface of the metal core 24*a*. Further, the parting layer 26*a* is, in order to improve a parting property to the toner, formed of, e.g., 100 μm-thick fluorine-containing resin material (e.g., a PFA tube) and coats a surface of the elastic layer 25*a*.

On the other hand, the metal core 24*b* of the pressing roller 22 is, e.g., formed of stainless steel with 54 mm in outer diameter, 5 mm in thickness and 350 mm in length. Further, the elastic layer 25*b* is formed of, e.g., 3 mm-thick silicone rubber (e.g., JIS-A hardness of 20 degrees) and coats an outer peripheral surface of the metal core 24*b*. Further, the parting layer 26*b* is, in order to improve a parting property to the toner, formed of, e.g., 100 μm-thick fluorine-containing resin material (e.g., a PFA tube) and coats a surface of the elastic layer 25*b*.

Further, inside the metal core 24*a* of the fixing roller 21, a halogen heater 27*a* (heat generating element), which is a third heating means, generates heat by energization and has (normal) rated power of, e.g., 1200 W, is disposed over a substantially whole area with respect to a widthwise direction (longitudinal direction, axial direction) of the fixing roller 21. Further, the halogen heater 27*a* internally heats the fixing roller 21 so that a surface temperature of the fixing roller 21 reaches a predetermined target temperature (third target temperature). Incidentally, the surface temperature of the fixing roller 21 is detected by a thermistor 28*a*, which is a third temperature detecting member described later. Then, on the basis of this detected temperature, the halogen heater 27*a* is ON/OFF-controlled by a CPU 29 (heater controller) which is a contact means, so that the surface temperature of the fixing roller 21 is temperature-controlled at the predetermined target temperature (third target temperature) of, e.g., 200° C.

On the other hand, also inside the metal core 24*b* of the pressing roller 22, a halogen heater 27*b* (heat generating element), which is a pressing member heating means, generates heat by energization and has (normal) rated power of, e.g., 300 W, is disposed over a substantially whole area with respect to a widthwise direction (longitudinal direction, axial direction) of the pressing roller 22. Further, the halogen heater 27*b* internally heats the pressing roller 22 so that a surface temperature of the pressing roller 22 reaches a predetermined temperature. Incidentally, the surface temperature of the pressing roller 22 is detected by a thermistor 28*b*, which is a temperature detecting member described later. Then, on the basis of this detected temperature, the halogen heater 27*b* is ON/OFF-controlled by a CPU 29, so that the surface temperature of the fixing roller 21 is temperature-controlled at the predetermined temperature of, e.g., 130° C.

Further, the pressing roller 22 is pressed against the fixing roller 21 at a predetermined pressure by an unshown pressing means to form the fixing nip N1 with the fixing roller 21, and is rotated by the rotation of the fixing roller 21 in an arrow B direction. Further, the recording material is nip-conveyed in the fixing nip N1. Incidentally, a circumferential width of the fixing nip N1 is, e.g., about 10 mm.

Figure 4:
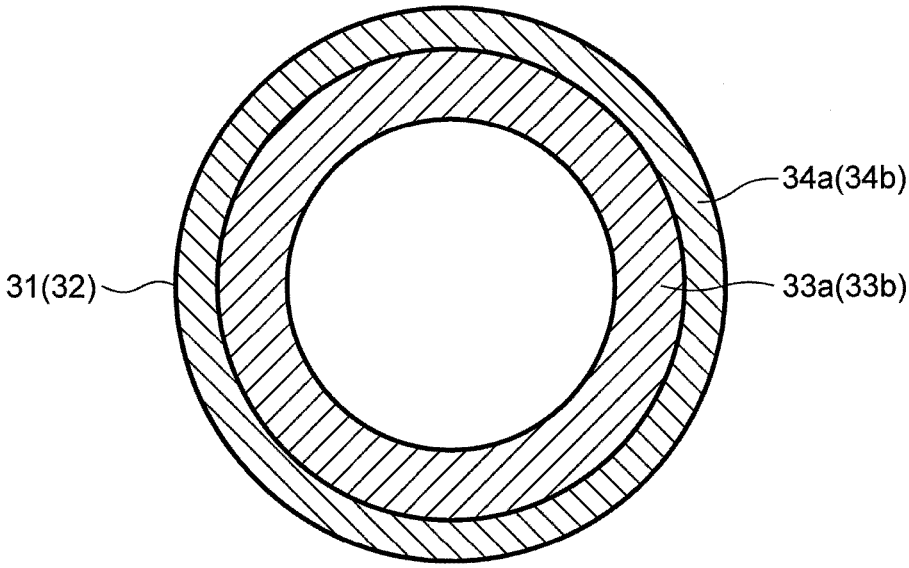
FIG. 4 is a schematic sectional illustration of an external heating roller.

Further, the belt member 23 is stretched by an external heating roller 31, which is a first belt heating member and an external heating roller 32, which is a second belt heating member. These external heating rollers 31 and 32, as shown in FIG. 4, include cylindrical metal cores 33*a* and 33*b* formed of e.g., aluminum with 30 mm in outer diameter, 3 mm in thickness and 350 mm in length. Outer peripheral surfaces of the metal cores 33*a* and 33*b* are, in order to reduce abrasion with an inner peripheral surface of the belt member 23, coated with heat-resistant sliding layers 34*a* and 34*b* formed of, e.g., a 20 μm-thick fluorine-containing resin material (e.g., a PFA tube).

Such external heating rollers 31 and 32 are urged toward the fixing roller 21 through the belt member 23 by an unshown urging means with a predetermined pressure. Further, the belt member 23 is contacted to the surface of the fixing roller 21 to form an external heat contact portion N2. The belt member 23 and the external heating rollers 31 and 32 are rotated in an arrow C direction and an arrow D direction, respectively, by the rotation of the fixing roller 21. Incidentally, the circumferential width of the external heat contact portion N2 is, e.g., about 40 mm. Further, the external heating rollers 31 and 32 are disposed to sandwich the external heat contact portion N2 with respect to a rotational direction of the belt member 23. Further, the external heating roller (upstream roller) 31 and the external heating roller (downstream roller) 32 are disposed adjacently to the external heat contact portion N at an upstream side and a downstream side, respectively. Therefore, the external heating roller 32 is disposed downstream of the external heating roller 31 with respect to the rotational direction of the fixing roller 21.

Figure 5:
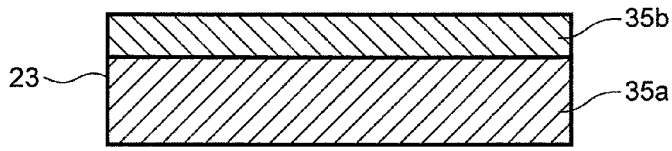
FIG. 5 is a schematic sectional illustration of a belt member.

Further, the belt member 23 is, as shown in FIG. 5, prepared by superposing an endless metal-made supporting material 35*a* and a heat-resistant sliding layer 35*b* from an inner diameter (portion) side. Of these, the supporting material 35*a* is formed of, e.g., stainless steel with 60 mm in outer diameter, 50 μm in thickness and 350 mm in length. Further, the sliding layer 35*b* is, in order to reduce adhesion to the toner, formed of, e.g., 20 μm-thick fluorine-containing resin material (e.g., a PFA tube) and coats an outer peripheral surface of the supporting material 35*a*.

Further, inside the upstream roller 31 (first stretching roller), a halogen heater 36, which is a first heating means, generates heat by energization and has a rated power of, e.g., 600 W, and is disposed over a substantially whole area with respect to the widthwise direction of the upstream roller 31. Further, inside the downstream roller 32 (second stretching roller), a halogen heater 37, which is a second heating means, generates heat by energization and has a rated power of, e.g., 1000 W, and is disposed over a substantially whole are with respect to the widthwise direction of the downstream roller 32. In this embodiment, values of power supplied to the respective heaters 36 and 37 are set so that a maximum of the power supplied to the halogen heater (upstream heater) 36 is smaller than a maximum of the power supplied to the halogen heater (downstream heater) 37 disposed downstream of the halogen heater 36. Further, the belt member 23 is internally heated by these heaters so that the surface temperature of the belt member 23 reaches a predetermined target temperature. Further, in this embodiment, the power (heat-generation amount) of the upstream heater 36 is made smaller than the power (heat-generation amount) of the downstream heater 37 but the power of the downstream heater 37 is increased in an amount correspondingly to the decrease in power of the upstream heater 36. Incidentally, the widthwise directions described above is also the longitudinal direction and the axial direction of the rollers.

Further, the surface temperature of the belt member 23 is detected by a thermistor 38, which is a first temperature detecting member described later and by a thermistor 39 which is a second temperature detecting member described later. Of these, the thermistor 38 (upstream thermistor) 38 is disposed so as to be contacted to a first area (upstream area) D1, of the outer peripheral surface of the belt member 23, in which the belt member 23 is stretched by the upstream roller 31. The upstream area D1 is an area in which the upstream roller 31 contacts the belt member 23. Further, the thermistor 39 (downstream thermistor) 39 is disposed so as to be contacted to a second area (downstream area) D2, of the outer peripheral surface of the belt member 23 in which the belt member 23 is stretched by the downstream roller 32. The downstream area D2 is an area in which the downstream roller 32 contacts the belt member 23. These upstream area D1 and downstream area D2 are provided so as to sandwich the external heat contact portion N2 with respect to the rotational direction of the belt member 23. The upstream heater 36 and the downstream heater 37 are ON/OFF-controlled by the CPU 29 on the basis of the temperatures detected by the upstream thermistor 38 and the detect thermistor 39, respectively. As a result, the surface temperature of the belt member 23 is controlled at a predetermined target temperature (first target temperature, second target temperature) of, e.g., 220° C.

Incidentally, in this embodiment, the upstream roller 31 and the downstream roller 32 have the same outer diameter, and the upstream area D1 and the downstream area D2 have the same area. Further, the surface temperatures in the upstream area D1 and the downstream area D2 are controlled at the same target temperature (first target temperature, second target temperature). In this embodiment, the same target temperature refers to a temperature within ±5° C. of the target temperature. That is, a maximum difference between the temperature and the target temperature is 10° C. The temperature may also be substantially equal to (e.g., within ±1° C. of) the target temperature. However, the target temperature can be changed appropriately. For example, the target temperature (first target temperature) in the upstream area D1 can also be mode higher than the target temperature (second target temperature) in the downstream area D2 (e.g., by more than 10° C. as the difference therebetween). When the target temperature in the upstream area D1 is increased, a time of energization to the upstream heater 36 can be made longer. In summary, setting of such target temperatures is performed properly in a range in which a necessary heat quantity can be supplied to the fixing roller 21 in the external heat contact portion and the time of energization to the upstream heater 36 is ensured to less cause temperature non-uniformity while taking into account relationships with values of set power (heat-generation amount) of the respective heaters 36 and 37.

Figure 6:
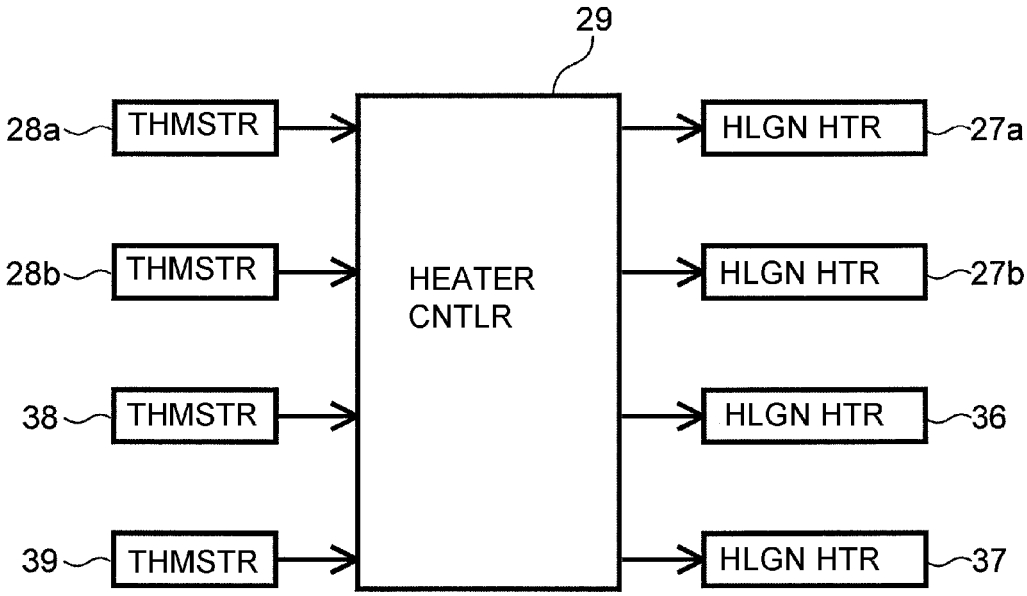
FIG. 6 is a block diagram of temperature control in Firs Embodiment.

The above-described control of the respective heaters 27*a*, 27*b*, 36 and 37 by the respective thermistors 28*a*, 28*b*, 38 and 39 is summarized as in a block diagram shown in FIG. 6. That is, on the basis of the temperatures detected by the thermistors 28*a*, 28*b*, 38 and 39, the CPU 29 effects the ON/OFF control of the heaters 27*a*, 27*b*, 36 and 37, respectively. Incidentally, disposing positions of the respective thermistors can be set arbitrarily, but the thermistors may preferably be disposed at widthwise central portions of the respective rollers.

Figure 7:
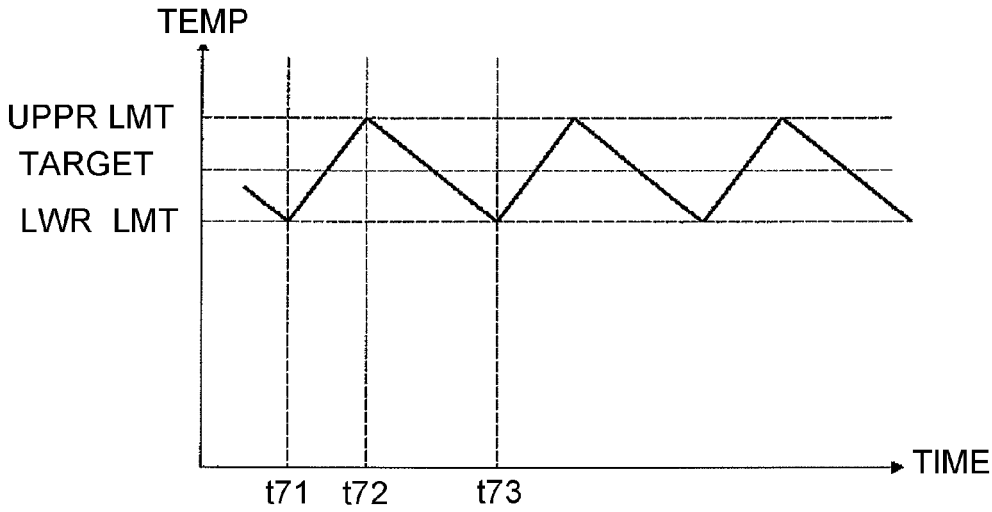
FIG. 7 is a graph showing a temperature change in the case where ON/OFF control of each heater is effected.

The ON/OFF control of each of the heater is effected in a manner as shown in FIG. 7. That is, when the temperature detected by the thermistor is lowered to a lower-limit set temperature at a time t71, the CPU 29 starts energization to the heater. By the turning-on of the heater, when the temperature detected by the thermistor reaches an upper-limit set temperature at a time t72, the energization is stopped, so that the heater is turned off. Then, the temperature detected by the thermistor is lowered again to the lower-limit set temperature at a time t73, the energization to the heater is resumed. Thereafter, such a sequence is repeated, so that the temperature (each of the surface temperatures of the fixing roller 21, the pressing roller 22 and the surface temperatures of the belt members 23 in the upstream area D1 and the downstream area D2) detected by the thermistor is controlled at a level between the lower-limit set temperature and the upper-limit set temperature. Incidentally, the upper-limit set temperature is set so as to be higher than the target temperature by, e.g., 1° C. and the lower-limit set temperature is set so as to be lower than the target temperature by, e.g., 1° C. That is, an average of the upper-limit set temperature and the lower-limit set temperature is the target temperature.

The above constituted rollers of the fixing device 20 perform a press-contact operation and a separation operation during printing and during stand-by state, respectively. This press-contact and separation control will be described. During the stand-by state, in order to prevent deformation or distortion of the elastic layer 25*a* of the fixing roller 21 and the elastic layer 26*b* of the pressing roller 22, members including the pressing roller 22, the external heating rollers 31 and 32 and the belt member 23 are separated from the fixing roller 21 by an unshown separating means. On the other hand, during the printing, i.e., during a fixing (heating) operation of the image on the recording material, the member including the pressing roller 22, the external heating rollers 31 and 32 and the belt member 23 are press-contacted to the fixing roller 21 by an unshown pressing means.

Incidentally, in the case where each of the rollers is kept in press-contact with the fixing roller 21 without being separated from the fixing roller 21 during the stand-by state, the deformation or distortion of the elastic layers in the fixing nip N1 and the external heat contact portion N2 remains also during the printing, so that a lateral stripe or glossy stripe (uneven glossiness) or the like is generated on the image to lower image quality. For that reason, as in this embodiment, each of the rollers may preferably be separated during the stand-by state.

Further, as described above, the fixing device 20 fixes the image, formed on the recording material P at the image forming portion, on the recording material P. That is, as shown in FIG. 2, the recording material P carrying thereon the toner K is conveyed in an arrow E direction and is introduced into the fixing nip N1. Then, the recording material P passes through the fixing nip N1 to be pressed and heated, so that the toner K (image) is heat-fixed on the recording material P. At this time, a portion where the heat of the surface of the fixing roller 21 is taken by the recording material P in the fixing nip N1 and where the temperature is lowered is heated by heat quantity from the halogen heater 27*a* and by the external heat contact portion N2, and is increased in temperature to a predetermined temperature. Thereafter, the heat application to the recording material P in the fixing nip N1 is repeated, so that the fixing operation is performed. On the other hand, a portion where the heat of the belt member is taken by the fixing roller 21 at the external heat contact portion N2 is heated at a contact portion with the downstream roller 32 and then is heated at a contact portion with the upstream roller 31 to be increased in temperature to a predetermined temperature. Thereafter, the heat application to the fixing roller 21 at the external heat contact portion N2 is repeated, so that the fixing operation is performed.

According to this embodiment as described above, the values of power supplied to the heaters 36 and 37 are set so that the maximum of the power supplied to the upstream heater 36 is lower than the maximum of the power supplied to the downstream heater 37 disposed portion of the upstream heater 36. For this reason, the time of energization to the upstream heater 36 can be prolonged. That is, the upstream area D1 in which the belt member 23 is heated by the upstream heater 36 is located before a position in which the belt member 23 heated by the downstream heater 37 reaches and the heat of the belt member 23 is taken by the external heat contact portion N2. For this reason, when the heat-generation amount of the upstream heater 36 is large, the surface temperature in the upstream area D1 reaches the upper-limit set temperature in a short time. On the other hand, as in this embodiment, when the maximum of the power supplied to the upstream heater 36 is made small, the time until the surface temperature in the upstream area D1 reaches the upper-limit set temperature, i.e., the energization time can be prolonged.

For this reason, temperature non-uniformity, such that the surface temperature of the belt member 23 is increased in a short time, is suppressed. In other words, a gradient of temperature rise with time becomes moderate, so that a portion where the temperature is abruptly changed can be eliminated. As a result, in a state in which the temperature non-uniformity is suppressed, the fixing roller 21 is heated at the external heat contact portion N2, so that the occurrence of image heating non-uniformity can be reduced.

Further, the target temperatures in the upstream area D1 and the downstream area D2 are set at the same target temperature, so that the energization time to the upstream heater 36 can be made longer. That is, in the case where the target temperature in the upstream area D1 is set at a value lower than the target temperature in the downstream area D2, the energization time to the upstream area D1 is not readily prolonged, but when the target temperatures in the both areas D1 and D2 are made equal to each other, the energization time to the upstream heater 36 supplied with a smaller value of the power can be prolonged. Further, as described above, in order to prolong the energization time to the upstream heater 36, the target temperature in the upstream area D1 may also be made higher than the target temperature in the downstream area D2.

Further, in this embodiment, the heaters 36 and 37 are disposed in the rollers 31 and 32, respectively, so that each of the heaters 36 and 37 can be efficiently disposed. However, the heaters 36 and 37 may also be disposed outside the rollers 31 and 32, respectively, e.g., so as to be opposed to the outer peripheral surface of the belt member 23. However, in this case, there is a need to ensure a disposing space of each of the heaters 36 and 37.

Further, in this embodiment, the maximum of the power supplied to the upstream heater 36 is made smaller than the maximum of the power supplied to the downstream heater 37, but the power supplied to the downstream heater 37 is increased in an amount correspondingly to the decrease in heat-generation amount of the upstream heater 36. For this reason, the fixing property can be maintained. That is, in order to retain the fixing property, there is a need to ensure the entire heat-generation amount required to heat the belt member 23. In this embodiment, the heat-generation amount of the downstream heater 37 is increased correspondingly to the decrease in heat-generation amount of the upstream heater 36, so that the surface temperature of the fixing roller 21 heated by the belt member 23 can be kept at a level which is not less than a lowest (point) temperature at which the fixing property can be retained, and thus the fixing property (performance) can be retained. Therefore, in this embodiment, it is possible to provide a fixing device capable of achieving fixing-property retainment and temperature-non-uniformity alleviation.

Further, the rated power (heat-generation amount) of the upstream heater 36 may preferably be made lower than that of the downstream heater 37 by 20% or more. As a result, the temperature non-uniformity alleviation effect as described above is liable to be obtained. That is, when the decrease is less than 20%, the alleviation of the temperature non-uniformity cannot be sufficiently realized but when the decrease is 20% or more, the alleviation of the temperature non-uniformity can be realized with reliability. That is, it is more suitable that "(rated power of downstream heater 37) (rated power of upstream heater 36)×1.2" is satisfied. However, even in the case where the heat-generation amount of the upstream heater 36 is excessively small, even when the heat-generation amount of the downstream heater 37 is increased, there is a possibility that the temperature in the upstream area D1 cannot be increased to a proper temperature. Therefore, the ratio of decrease in heat-generation amount of the upstream heater 36 to the downstream heater 37 is determined in view of this point.

Further, in this embodiment, the target temperatures in the contact areas D1 and D2 are made equal to each other at 220° C. in view of the upper-limit heat-resistant temperature of the members (thermistors or PFA tubes or the like) of the fixing device. However, when the temperature of the belt member 23 is low, heating power for increasing the temperature of the fixing roller 21 is lowered, so that the target temperatures in the contact areas D1 and D2 may suitably be set at high temperatures, which are lower than, but closest to, the heat-resistant temperature.

Further, in this embodiment, the fixing roller, including the heating source therein, as the image heating member is employed but the effect of the present invention is similar to that in a constitution in which the fixing roller is heated only the belt member. Further, in this embodiment, the pressing roller, including the heating source therein, as the pressing member is employed but the effect of the present invention is similar to that in a constitution in which the pressing roller is not provided with the heating means. Further, in this embodiment, as the pressing member, the pressing roller including the elastic layer on the metal core is employed, but the effect of the present invention is similar to that in other shapes such as a pressing belt, a pressing roller with no elastic layer or a pressing belt with no elastic layer.

Further, in this embodiment, as the heating means, the halogen heater is employed. However, even when the heating means, other than the halogen heater, of other types such as an electromagnetic induction heating type or a planer heat generating element is such as the heating means, if a constitution in which a plurality of heating means are provided is employed, the effect of the present invention is the same. Incidentally, in this case, there is a structure in which the power supply to the heating means is not turned off but a similar effect is obtained when the control is effected in the same manner as in the above case on the assumption that the power to be supplied is turned on in the case where the power is a maximum and is turned on in the case where the power is a minimum.

Further, in this embodiment, the constitution in which one halogen heater is provided in one stretching roller is employed. However, in the fixing device in which each of the first and second stretching rollers (31 and 32) is provided with a plurality of halogen heaters, the effect of the present invention can be obtained by employing the following constitution. That is, a total of values of the rated power of the halogen heaters provided in the first stretching roller 31 may be made smaller than a total of values of the rated power of the halogen heaters provided in the second stretching roller 32.

Further, in this embodiment, the same power as the rated power is supplied to each halogen heater. However, even in the case where the power less than the rated power is supplied, maximum power supplied to the upstream heater 36 is made smaller than maximum power supplied to the downstream heater 37, so that the effect of the present invention can be obtained.

Further, also in the case where each of the first and second belt heating members (stretching rollers 31 and 32) is provided with a plurality of halogen heaters and power less than the rated power is supplied, the effect of the present invention can be obtained. That is, a maximum of a total of values of the power supplied to the halogen heaters 36 provided in the stretching roller 31 may be made smaller than that of the power supplied to the halogen heaters 37 provided in the stretching roller 32.

Incidentally, the above-described constitutions may be similarly employed even when the heating means for heating the belt member 23 is three or more. For example, it would be considered that a constitution in which three rollers are disposed around the fixing roller 21 along the rotational direction of the fixing roller 21 and the heating means is provided in each roller is employed. In this case, the maximum of the power supplied to the heating means in an intermediate roller present between an upstream roller and a downstream roller may preferably be set as follows. Values of the power supplied to the respective heating means are set so that the maximum of the power supplied to the heating means in the intermediate roller is made lower than that of the power supplied to the heating means in the upstream roller and is made smaller than that of the power supplied to the heating means in the downstream roller.

<Confirmation of Effect of First Embodiment>

An experiment for confirming the effect of this embodiment as described above will be explained. In this experiment, for comparison with this embodiment, Comparative Embodiments 1 to 3 different in rated power of the upstream heater 36 and the downstream heater 37 were prepared. Incidentally, in this embodiment and Comparative Embodiments 1 to 3, the power equal to the rated power of each of the respective heaters 36 and 37 is supplied to each halogen heater. Further, in this experiment, as the recording material, sheets of A4-sized paper having a basis weight of 300 g/m$^2$ were continuously passed in a landscape direction at a speed of 100 ppm (pages per minute).

Comparative Embodiment 1

First, as Comparative Embodiment 1, a structure in which the upstream heater 36 and the downstream heater 37 have the same heat-generation amount and the rated power of each of the heaters 36 and 37 is 600 W will be described. That is, the case where the rated power of the upstream heater 36 in the upstream roller 31 is 600 W and the rated power of the downstream heater 37 in the downstream roller 32 is 600 W will be described.

Figure 8:
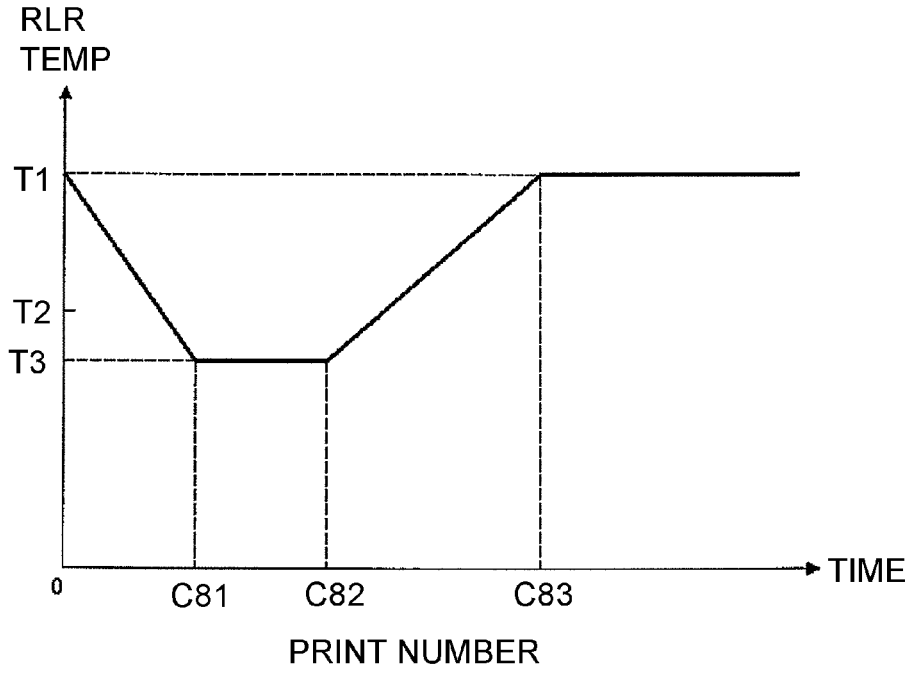
FIG. 8 is a graph showing a relationship between a print number and a fixing roller surface temperature in Comparative Embodiment 1.

FIG. 8 is a graph showing a temperature change of the fixing roller 21 after start of the printing in Comparative Embodiment 1. The temperature of the fixing roller 21 adjusted at a temperature T1 during the stand-by state is lowered when the printing is started and the recording material reaches the fixing nip N1, and reaches a lowest temperature T3 at a print number of C81. This is because the heat is blocked by the metal core 24*a* and the elastic layer 25*a* having low thermal conductivity even when the halogen heater 27*a* is turned on in order to keep the surface temperature of the fixing roller 21 at the temperature T1, and thus the surface temperature rise of the fixing roller 21 is delayed. Further, from the start of the sheet passing to a print number of C81, all the halogen heaters 27*a*, 28*b*, 36 and 37 were turned on. Then, when the print number exceeded C82, the temperature of the fixing roller 21 was increased from the lowest temperature T3 to reach the temperature T1 at a print number C83, so that the fixing roller 21 was in a steady state (equilibrium state).

In Comparative Embodiment 1, T1=200° C. and T3=175° C. are set. Here, a surface temperature T2=180° C. of the fixing roller 21 is the lower limit of a tolerable range in which the fixing property can be satisfied and therefore the fixing property at the lowest temperature T3=175° C. is out of the tolerable range. When the surface temperature of the fixing roller 21 was the lowest temperature T3, the temperature in the upstream area D1 was 210° C. and was lower than a set temperature of 220° C. of the belt member 23. Therefore, it was found that a total power of the halogen heaters 36 and 37 (the sum of values of the power at the external heating portion) of 1200 W was insufficient as the power and there was a need to further increase the sum of the values of the power at the external heating portion.

Further, detected temperatures by the thermistors 28*b*, 38 and 39 in the steady state of the fixing roller 21 in which the temperature of the fixing roller 21 was T1 were 130° C. for the surface temperature of the pressing roller 21, 220° C. for the temperature in the upstream area D1 and 220° C. for the temperature in the downstream area D2. Further, the temperatures in the contact areas D1 and D2 were temperature controlled at the target temperature of 220° C.

Figure 9:
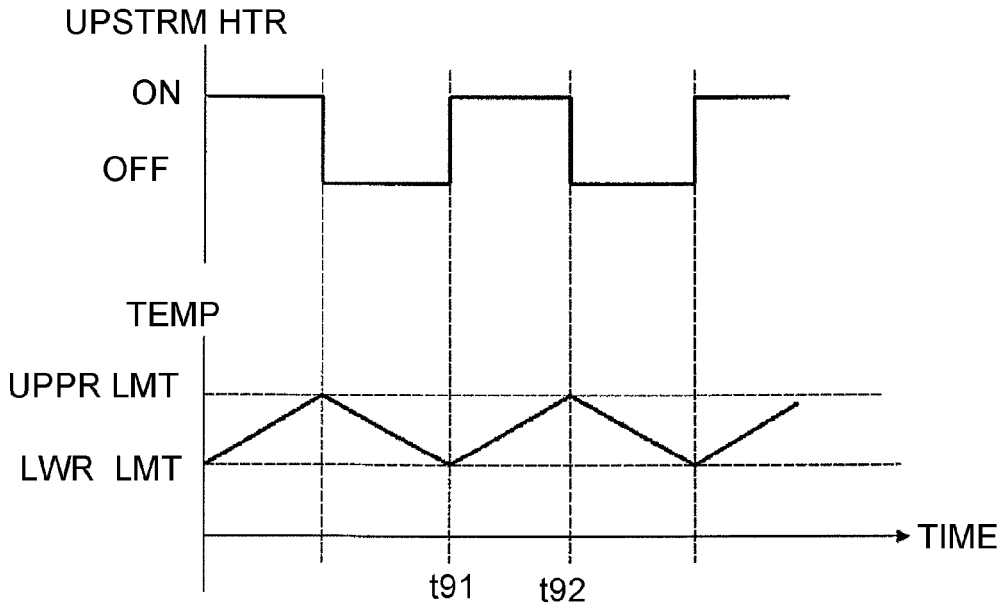
FIG. 9 is a graph showing ON/OFF control of an upstream heater and a temperature change in Embodiment 1 and Comparative Embodiment 1.

FIG. 9 is a graph showing ON/OFF of energization to the upstream heater 36 in the steady state in Comparative Embodiment 1 and a temperature change in the upstream area D1 in the state. At a time t91, the surface temperature in the upstream area D1 was lowered to a lower-limit set temperature and the energization to the upstream heater 36 was turned on. The power supplied to the upstream heater 36 was 600 W, which was small, so that the temperature in the upstream area D1 moderately reached an upper-limit set temperature in a long period from the time t91 to a time t92. In this case, the belt member 23 was warmed in the long period, so that surface temperature non-uniformity of the belt member 23 was inconspicuous. For that reason, surface temperature non-uniformity of the fixing roller 21 contacted to the belt member 23 at the external heat contact portion N2 was also inconspicuous.

Comparative Embodiment 2

Next, as Comparative Embodiment 2, a structure in which the upstream heater 36 and the downstream heater 37 have the same heat-generation amount and the rated power of each of the heaters 36 and 37 is 800 W will be described. That is, the case where the rated power of the upstream heater 36 in the upstream roller 31 is 800 W and the rated power of the downstream heater 37 in the downstream roller 32 is 800 W will be described.

Figure 10:
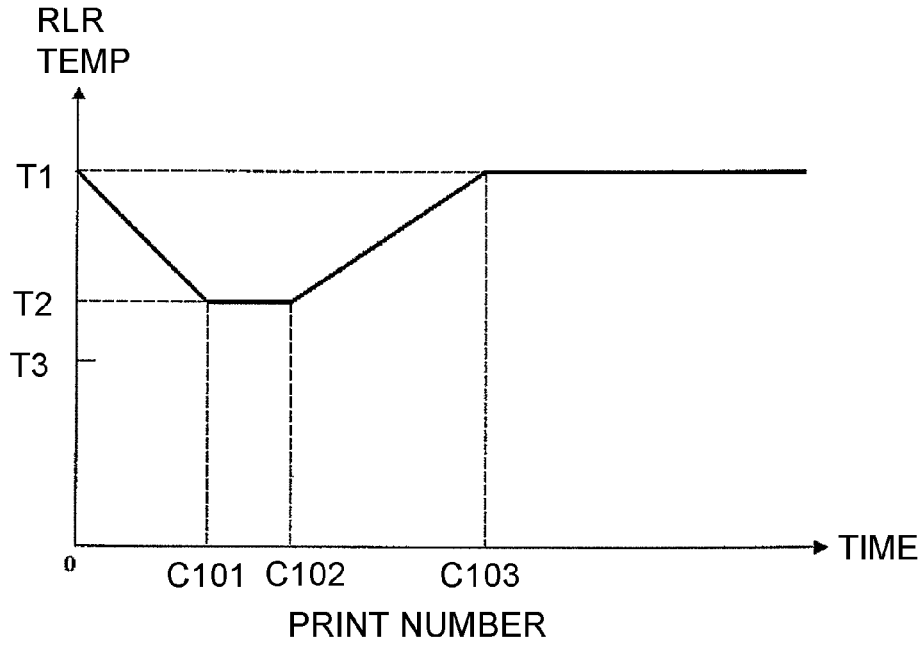
FIG. 10 is a graph showing a relationship between a print number and a fixing roller surface temperature in Comparative Embodiments 2 and 3.

FIG. 10 is a graph showing a temperature change of the fixing roller 21 after start of the printing in Comparative Embodiment 2. The temperature of the fixing roller 21 adjusted at a temperature T1 during the stand-by state is lowered when the printing is started and the recording material reaches the fixing nip N1, and reaches a lowest temperature T2 at a print number of C101. Further, similarly as in Comparative Embodiment 1, from the start of the sheet passing to a print number of C101, all the heaters 27*a*, 28*b*, 36 and 37 were turned on. Then, when the print number exceeded C102, the temperature of the fixing roller 21 was increased from the lowest temperature T2 to reach the temperature T1 at a print number C103, so that the fixing roller 21 is in a steady state (equilibrium state).

In Comparative Embodiment 2, T1=200° C. and T2=180° C. are set. Here, the lowest temperature T2 (>T3) was the lower limit of a tolerable range in which the fixing property can be satisfied and therefore the fixing property at this temperature was within the tolerable range. This is caused because, compared with Comparative Embodiment 1, the total rated power of the belt member 23 is large and thus heat supplied to the belt in the contact areas D1 and D2 is great. The lowest temperature T2 was the lower limit of the tolerable range of the fixing property and therefore, it was found that a total power of the halogen heaters 36 and 37 (the sum of values of the power at the external heating portion) of 1600 W was lower limit power with which the fixing property fallen within the tolerable range at the lowest temperature during continuous sheet passing.

Further, detected temperatures by the thermistors 28*b*, 38 and 39 in the steady state of the fixing roller 21 in which the temperature of the fixing roller 21 was T1 were as follows. That is, the detected temperature were 130° C. for the surface temperature of the pressing roller 21, 220° C. for the temperature in the upstream area D1 and 220° C. for the temperature in the downstream area D2. Further, similarly as in Comparative Embodiment 1, the temperatures in the contact areas D1 and D2 were temperature controlled at the target temperature of 220° C.

Figure 11:
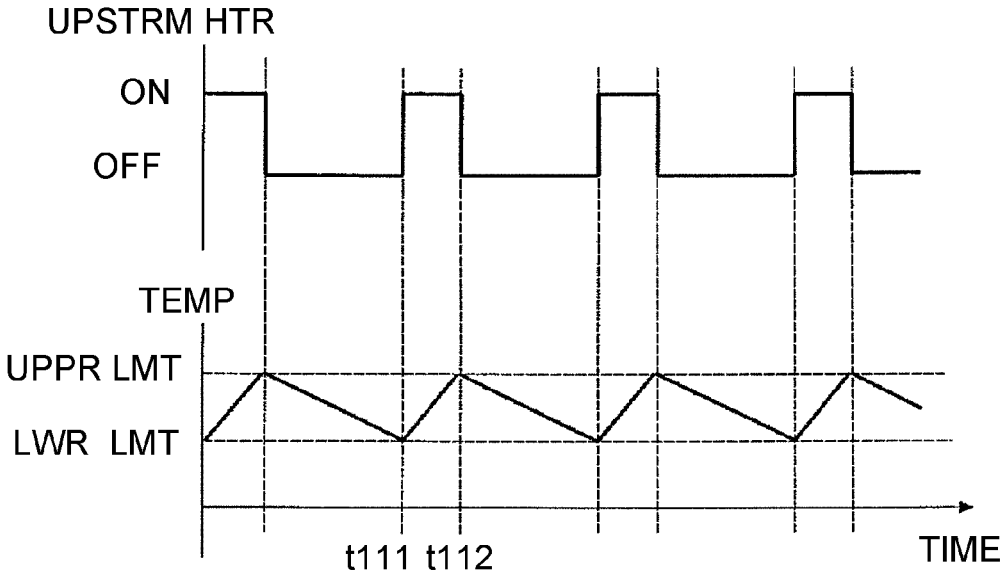
FIG. 11 is a graph showing ON/OFF control of an upstream heater and a temperature change in Comparative Embodiment 2.

FIG. 11 is a graph showing ON/OFF of energization to the upstream heater 36 in the steady state in Comparative Embodiment 2 and a temperature change in the upstream area D1 in the state. At a time till, the surface temperature in the upstream area D1 was lowered to a lower-limit set temperature and the energization to the upstream heater 36 was turned on. The power supplied to the upstream heater 36 was 800 W, which was large, so that the temperature in the upstream area D1 reached an upper-limit set temperature in a short period from the time t111 to a time t112. In this case, the belt member 23 was warmed in the short period, so that surface temperature non-uniformity of the belt member 23 was inconspicuous. For that reason, surface temperature non-uniformity of the belt member 23 was transferred onto the surface of the fixing roller 21 contacted to the belt member 23 at the external heat contact portion N2, so that the temperature non-uniformity occurred also at the surface of the fixing roller 21. Therefore, in order to reduce the surface temperature non-uniformity of the fixing roller 21 in the steady state, it was found that either the rated power of the heating means 36 or the rated power of the halogen heater 37 was required to be decreased.

Comparative Embodiment 3

Next, as Comparative Embodiment 3, a structure in which the heat-generation amount of the upstream heater 36 is made larger than that of the downstream heater 37 will be described. That is, the case where the rated power of the upstream heater 36 is 1000 W and the rated power of the downstream heater 37 is 600 W will be described. Incidentally, in this Comparative Embodiment 3, the temperature change was similar to that in Comparative Embodiment 2. That is, as described above and shown in FIG. 10, the temperature of the fixing roller 21 adjusted at a temperature T1 during the stand-by state was lowered when the printing was started and the recording material reached the fixing nip N1, and reached a lowest temperature T2 at a print number of C101. Further, similarly as in Comparative Embodiment 1, from the start of the sheet passing to a print number of C101, all the heaters 27*a*, 28*b*, 36 and 37 were turned on. Then, when the print number exceeded C102, the temperature of the fixing roller 21 was increased from the lowest temperature T2 to reach the temperature T1 at a print number C103, so that the fixing roller 21 was in a steady state (equilibrium state).

Also, in Comparative Embodiment 3, T1=200° C. and T2=180° C. are set. That is, a total power of the halogen heaters 36 and 37 (the sum of values of the power at the external heating portion) was 1600 W similarly as in Comparative Embodiment 2 and therefore the lowest temperature was T2.

Further, detected temperatures by the thermistors 28*b*, 38 and 39 in the steady state of the fixing roller 21 in which the temperature of the fixing roller 21 was T1 were similar to those in Comparative Embodiments 1 and 2. That is, the detected temperature were 130° C. for the surface temperature of the pressing roller 21, 220° C. for the temperature in the upstream area D1 and 220° C. for the temperature in the downstream area D2. Further, the temperatures in the contact areas D1 and D2 were temperature controlled at the target temperature of 220° C.

Figure 12:
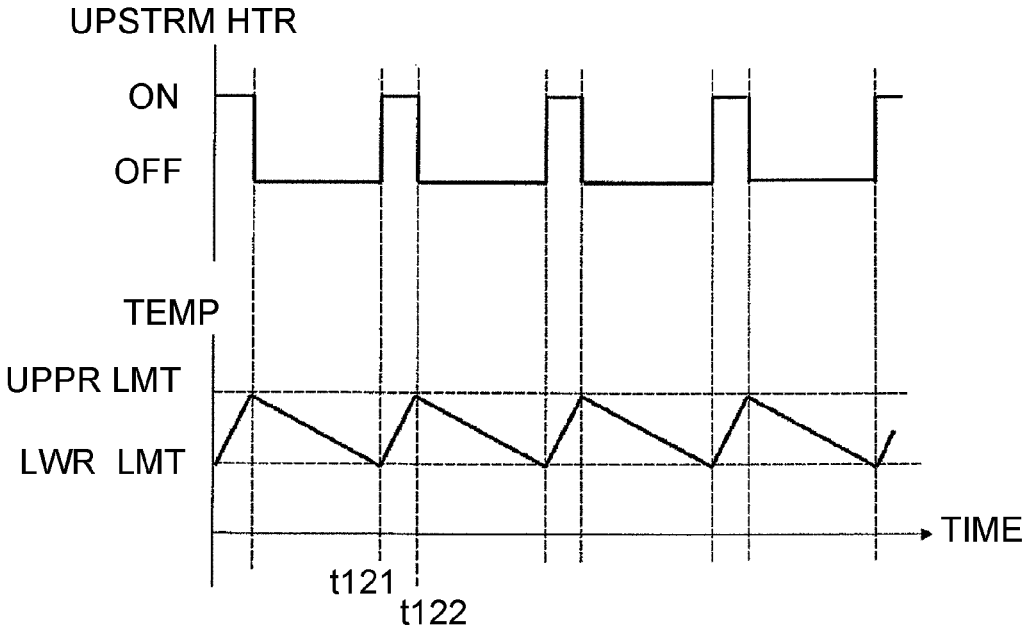
FIG. 12 is a graph showing ON/OFF control of an upstream heater and a temperature change in Comparative Embodiment 3.

FIG. 12 is a graph showing ON/OFF of energization to the upstream heater 36 in the steady state in Comparative Embodiment 3 and a temperature change in the upstream area D1 in the state. At a time t121, the surface temperature in the upstream area D1 was lowered to a lower-limit set temperature and the energization to the upstream heater 36 was turned on. The power supplied to the upstream heater 36 was 1000 W which was further large compared with that in Comparative Embodiment 2, so that the temperature in the upstream area D1 reached an upper-limit set temperature in a further short period from the time t121 to a time t122. In this case, the belt member 23 was warmed in the further short compared with that in Comparative Embodiment 2 period, so that surface temperature non-uniformity of the belt member 23 was worsened. For that reason, at the surface of the fixing roller 21 contacted to the belt member 23 at the external heat contact portion N2, compared with Comparative Embodiment 2, further worsened temperature non-uniformity occurred. This is because the surface temperature non-uniformity of the belt member 23 is transferred and thus the temperature non-uniformity occurs also at the surface of the fixing roller 21.

From the above-described Comparative Embodiments, it was found that the surface temperature non-uniformity of the belt member 23 occurred in the upstream area D1 immediately before the external heat contact portion N2 was transferred onto the fixing roller 21 in the external heat contact portion N2 and thus the surface temperature non-uniformity of the fixing roller 21 occurred. Therefore, in order to reduce the surface temperature non-uniformity of the fixing roller 21 in the steady state, it was found that either the rated power of the upstream heater 36 for heating the upstream area D1 immediately before the external heat contact portion N2 was required to be decreased. Therefore, in order to reduce the surface temperature non-uniformity of the fixing roller 21 in the steady state, it was found that either the rated power of the upstream heater 36 for heating the upstream area D1 immediately before the external heat contact portion N2 was required to be decreased.

Embodiment 1

Next, a structure of Embodiment 1 satisfying the features of First Embodiment will be described. In this embodiment, the rated power of the upstream heater 36 was 600 W and the rated power of the downstream heater 37 was 1000 W. Incidentally, in this embodiment, the temperature change was similar to that in Comparative Embodiments 2 and 3. That is, as described above and shown in FIG. 10, the temperature of the fixing roller 21 adjusted at a temperature T1 during the stand-by state was lowered when the printing was started and the recording material reached the fixing nip N1, and reached a lowest temperature T2 at a print number of C101. Further, similarly as in Comparative Embodiment 1, from the start of the sheet passing to a print number of C101, all the heaters 27*a*, 28*b*, 36 and 37 were turned on. Then, when the print number exceeded C102, the temperature of the fixing roller 21 was increased from the lowest temperature T2 to reach the temperature T1 at a print number C103, so that the fixing roller 21 was in a steady state (equilibrium state).

Also, in this embodiment, T1=200° C. and T2=180° C. are set. That is, a total power of the halogen heaters 36 and 37 (the sum of values of the power at the external heating portion) was 1600 W similarly as in Comparative Embodiments 2 and 3 and therefore the lowest temperature was T2.

Further, detected temperatures by the thermistors 28*b*, 38 and 39 in the steady state of the fixing roller 21 in which the temperature of the fixing roller 21 was T1 were similar to those in Comparative Embodiments 1 to 3. That is, the detected temperature were 130° C. for the surface temperature of the pressing roller 21, 220° C. for the temperature in the upstream area D1 and 220° C. for the temperature in the downstream area D2. Further, the temperatures in the contact areas D1 and D2 were temperature controlled at the target temperature of 220° C.

Further, ON/OFF of energization to the upstream heater 36 in the steady state in this embodiment and a temperature change in the upstream area D1 in the state were similar to those in Comparative Embodiment 1. That is, as described above and shown in FIG. 9, at a time t91, the surface temperature in the upstream area D1 was lowered to a lower-limit set temperature and the energization to the upstream heater 36 was turned on. The power supplied to the upstream heater 36 was 600 W similar as in Comparative Embodiment 1, so that the temperature in the upstream area D1 moderately reached an upper-limit set temperature in a long period from the time t91 to a time t92. In this case, the belt member 23 was warmed in the long period, so that surface temperature non-uniformity of the belt member 23 was inconspicuous (suppressed). For that reason, the surface temperature non-uniformity of the fixing roller 21 contacted to the belt member 23 at the external heat contact portion N2 was also inconspicuous.

Further, the power supplied to the downstream heater 37 for heating the downstream area D2 was 1000 W and therefore the surface temperature non-uniformity occurred in the downstream area D2 was conspicuous but it was found that this surface temperature non-uniformity was improved during the sheet passing in the upstream area D1. That is, it was found that the surface temperature non-uniformity was caused principally because the surface temperature non-uniformity of the belt member 23 occurred in the upstream area D1 immediately before the external heat contact portion N2 was transferred. Further, it was found that the surface temperature non-uniformity of the belt member 23 occurred in the downstream area D2 was reduced before the portion where the surface temperature non-uniformity occurred reached the external heat surface temperature N2, and therefore was not transferred onto the fixing roller 21.

As described above, in this embodiment, the rated power of the downstream heater 37 downstream of the fixing roller 21 (the belt member 23) with respect to the rotational direction of the fixing roller 21 was increased, and the rated power of the upstream heater 36 upstream of the fixing roller 21 with respect to the rotational direction of the fixing roller 21 was decreased. As a result, it was possible to provide the fixing device capable of maintaining the fixing property (the lowest temperature) and capable of reducing (alleviating) the temperature non-uniformity.

Second Embodiment

Second Embodiment of the present invention will be described with reference to FIG. 13 to FIG. 16. This embodiment relates to a constitution for efficiently achieving reduction of a non-sheet-passing-portion temperature rise occurring when a small-sized paper is passed and prevention of lowering in the lowest temperature of the fixing member (image heating member). Incidentally, also in this embodiment, the power equal to the rated power for each halogen heater is supplied to each halogen heater.

The fixing device is, in the case where the small-sized paper passes through the fixing device, increased in temperature in an outside area (non-sheet-passing portion), for the small size (predetermined size) deviated from a sheet-passing portion, which is a sheet-passing area (sheet-passing portion) in which the predetermined-size recording material passes through the fixing device in the fixing nip, with respect to the widthwise direction. This is because the heat of the fixing member or the pressing member is taken by the recording material at the sheet-passing portion and therefore is supplied, in order to ensure the fixing property, to the fixing member or the pressing member, thereby keeping the fixing member or the pressing member at a predetermined temperature. On the other hand, at the non-sheet-passing portion, the heat of the fixing member or the pressing member is not taken and is continuously supplied, so that the temperatures of members for the fixing device, such as the fixing roller (fixing member), the pressing roller (pressing member), the thermistors, are increased. In the case where the temperatures of the members for the fixing device exceed the heat-resistant temperature, there arises such a problem that, e.g., the elastic layer, the parting layer, the thermistors and the like are broken by thermal deterioration.

As a countermeasure against such non-sheet-passing-portion temperature rise, a constitution a plurality of heating sources different in heat-generation distribution with respect to the longitudinal direction are provided for those of the fixing-device members is employed. In this constitution, heat generation of the heating sources at the non-sheet-passing portion is reduced, depending on the size of the recording material or on a detected temperature by a temperature detecting means disposed at the non-sheet-passing portion of each of the fixing-device members. Thus, the temperature rise of the fixing-device members at the non-sheet-passing portion is suppressed while keeping the fixing-device members at the sheet-passing portion.

A fixing device 20A in this embodiment in which such countermeasure against the non-sheet-passing-portion temperature rise is provided will be described. However, members having the same constitutions and functions as those in the fixing device 20 in First Embodiment described above are represented by the same reference numerals or symbols and will be omitted from description. Incidentally, in the image forming apparatus in this embodiment, a center (line)-based sheet passing is employed and irrespective of the size of the recording material, a fixing operation for the recording material is performed in a state in which a central portion of the recording material with respect to a roller widthwise direction is substantially aligned which central portions of the fixing roller 21, the pressing roller 22 and the belt member 23 with respect to their widthwise directions. For this reason, in this embodiment, the widths of the fixing roller 21, the pressing roller 22 and the belt member 23 are made substantially equal to each other and the widthwise central portions of these members 21, 22 and 23 are also substantially aligned with each other.

Figure 13:
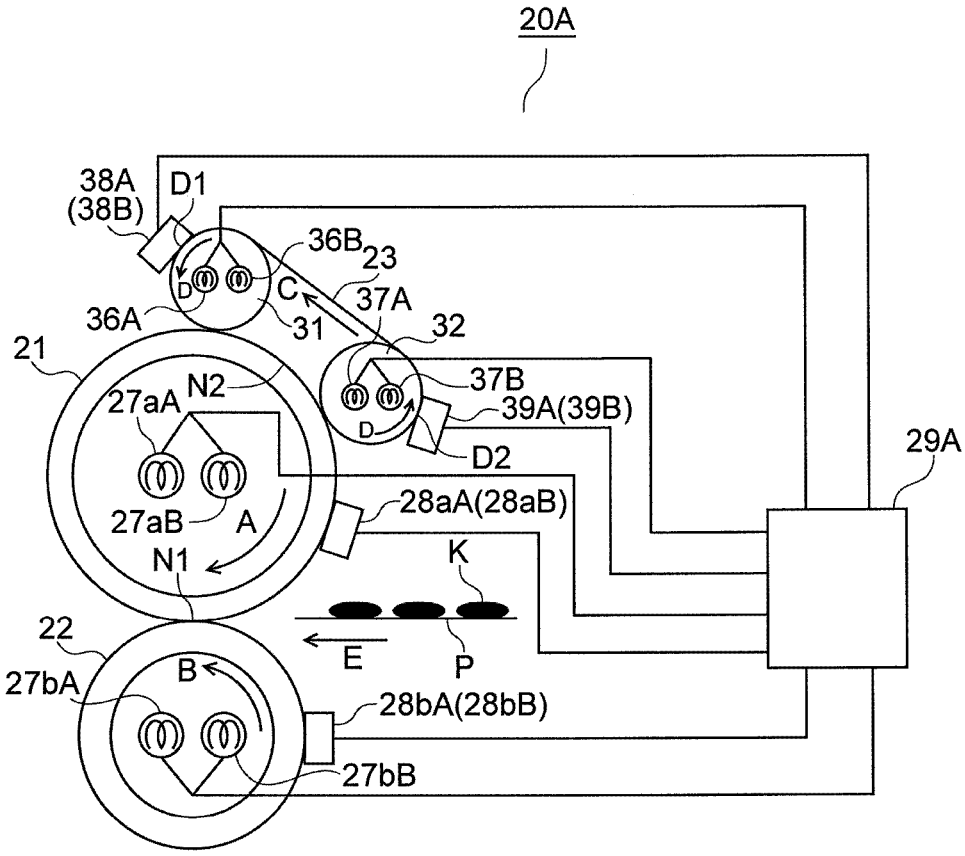
FIG. 13 is a schematic illustration of a fixing device according to Second Embodiment.

The fixing device 20A in this embodiment has almost the same constitution as that of the fixing device 20 in First Embodiment, but is different in that two halogen heaters are disposed as a heating means for heating each of the rollers. As shown in FIG. 13, inside the fixing roller 21, each of halogen heaters 27*a*A and 27*a*B, which generates heat by energization and has rated power of, e.g., 600 W, is disposed over a substantially whole widthwise direction of the fixing device 21. Thus, total rated power of the halogen heaters 27*a*A and 27*a*B is 1200 W. However, the halogen heaters 27*a*A and 27*a*B are made different in widthwise heat-generation distribution from each other.

Further, the halogen heater 27*a*A has a heat-generation amount that is larger, at a portion for heating the sheet-passing portion, than that in the outside area (non-sheet-passing portion) for the predetermined size deviated from the sheet-passing area (sheet-passing portion) in which the predetermined-size recording material passes through the fixing nip N1. In this embodiment, a roller widthwise central portion where the small-sized recording material passes is the sheet-passing portion, and roller widthwise end portions deviated from (outside) the small-sized recording material passing portion is the non-sheet-passing portion.

Figure 14:
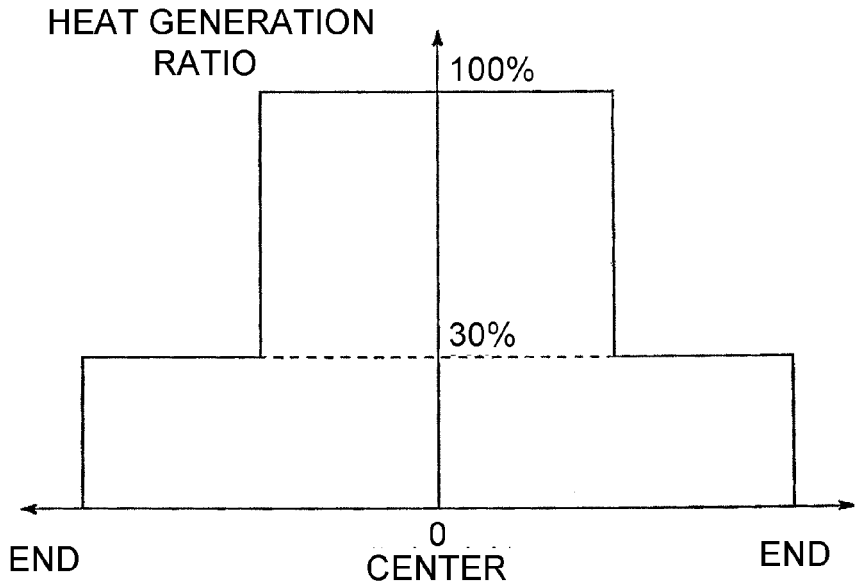
FIG. 14 is a graph showing heat-generation distribution of a main heater.

Therefore, the halogen heater 27*a*A is, as shown in FIG. 14, adjusted so that the heat-generation amount of the portion for heating the roller widthwise end portions is, e.g., 30% of the heat-generation amount of the portion for heating the roller widthwise central portion when the rated power is inputted. That is, the heat-generation amount at the end portions is smaller than that at the central portion when the rated power is inputted into the halogen heater 27*a*A. Specifically, a pitch of a filament constituting the halogen heater 27*a*A is decreased at the central portion, but is increased at the end portions, so that the heat-generation amount with respect to the roller widthwise direction is adjusted. Hereinafter, the halogen heater 27*a*A is referred to as a main heater 27*a*A.

On the other hand, the halogen heater 27*a*B has the heat-generation amount which is larger, at the portion for heating the outside area (non-sheet-passing portion) for the predetermined size deviated from the sheet-passing portion, than that at the sheet-passing area (sheet-passing portion) in which the predetermined-size recording material passes.

Figure 15:
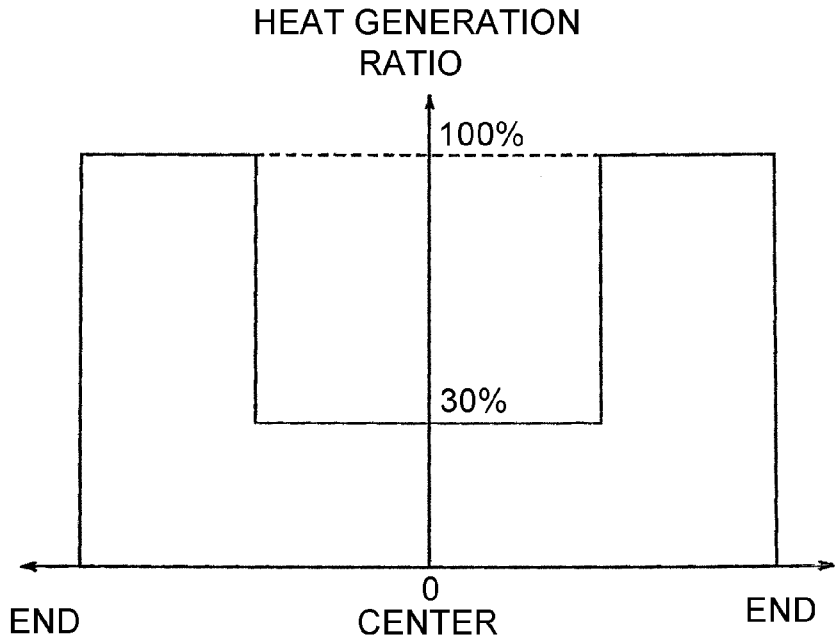
FIG. 15 is a graph showing heat-generation distribution of a sub-heater.
Figure 16:
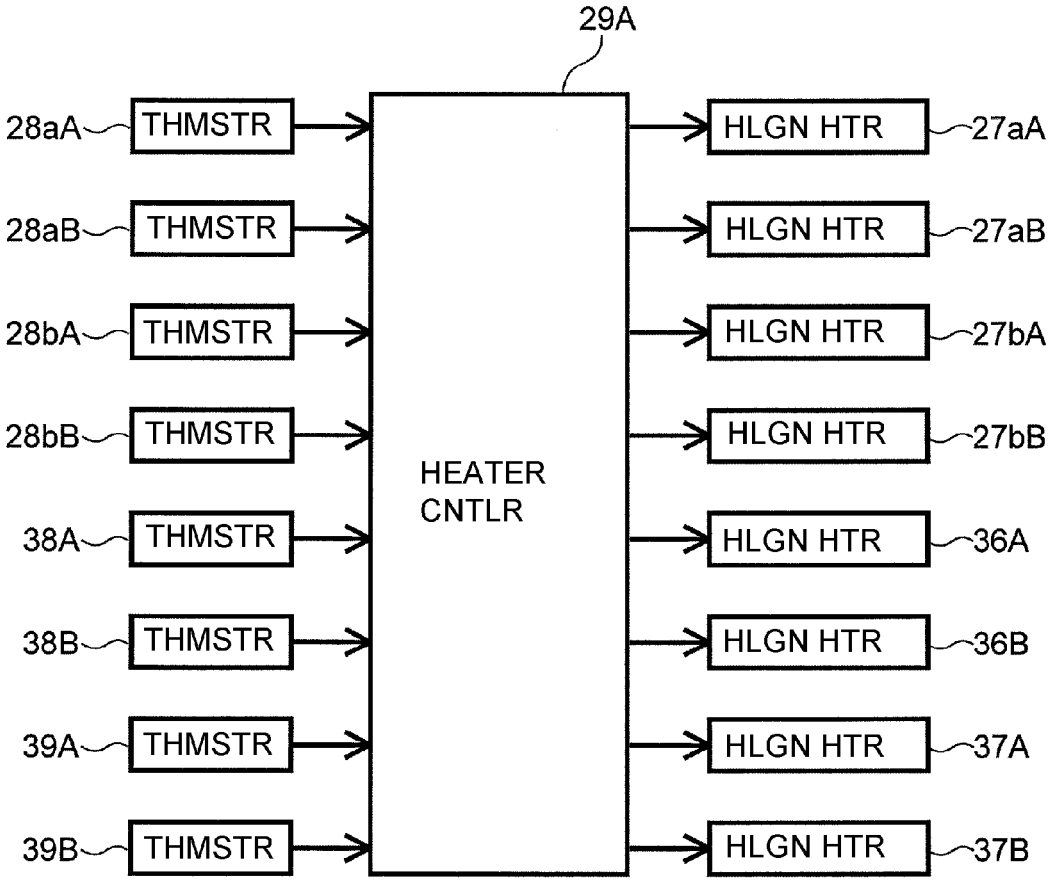
FIG. 16 is a block diagram of temperature control in Second Embodiment.

Therefore, the halogen heater 27*a*B is, as shown in FIG. 15, adjusted so that the heat-generation amount of the roller widthwise end portions is, e.g., 30% of the heat-generation amount of the roller widthwise central portion when the rated power is inputted. That is, the heat-generation amount at the central portion is smaller than that at the end portions when the rated power is inputted into the halogen heater 27*a*B. Specifically, a pitch of a filament constituting the halogen heater 27*a*B is decreased at the end portions but is increased at the central portion, so that the heat-generation amount with respect to the roller widthwise direction is adjusted. Hereinafter, the halogen heater 27*a*B is referred to as a sub-heater 27*a*B.

Further, the surface temperature of the fixing roller 21 is detected by a thermistor 28*a*A as a temperature detecting means contacted to the sheet-passing portion of the fixing roller 21. Then, on the basis of this detected temperature, a CPU (developer controller) 29A as a temperature-control (adjusting) means turns on and off the main heater 27*a*A and the sub-heater 27*a*B to control the surface temperature of the fixing roller 21 at the predetermined target temperature of, e.g., 200° C. This control is also effected similarly as in First Embodiment so that the upper-limit set temperature is set at a value higher than the target temperature by 1° C. and the lower-limit set temperature is set at a value lower than the target temperature by 1° C.

Further, by a thermistor 28*a*B as the temperature detecting means contacted to the non-sheet-passing portion of the fixing roller 21, the surface temperature of the fixing roller 21 at the non-sheet-passing portion is monitored. Therefore, the thermistor 28*a*A is a temperature controlling thermistor for controlling the main heater 27*a*A and the sub-heater 27*a*B so that the surface temperature of the fixing roller 21 at the sheet-passing portion and hereinafter is referred to as a main thermistor 28*a*A. Further, the thermistor 28*a*B is a thermistor for monitoring the surface temperature of the fixing roller 21 at the non-sheet-passing portion and hereinafter is referred to as a sub-thermistor 28*a*B.

Further, inside the pressing roller 22, as shown in FIG. 13, each of halogen heaters 27*b*A and 27*b*B, which generates heat by energization and has rated power of, e.g., 150 W, is disposed over a substantially whole widthwise direction of the pressing roller 22. Thus, total rated power of the halogen heaters 27*b*A and 27*b*B is 300 W. However, the halogen heaters 27*b*A and 27*b*B are made different in widthwise heat-generation distribution from each other. That is, the halogen heater 27*b*A has the heat-generation distribution as shown in FIG. 14, and the halogen heater 27*b*B has the heat-generation distribution as shown in FIG. 15. Hereinafter, the halogen heater 27*b*A is referred to as a main heater 27*b*A, and the halogen heater 27*b*B is referred to as a sub-heater 27*b*B.

Further, the surface temperature of the pressing roller 22 is detected by a thermistor 28*b*A as a temperature detecting means contacted to the sheet-passing portion of the fixing roller 21. Then, the CPU 29A turns on and off the main heater 27*b*A and the sub-heater 27*b*B to control the surface temperature of the pressing roller 22 at the predetermined target temperature of, e.g., 130° C. This control is also effected similarly as in First Embodiment so that the upper-limit set temperature is set at a value higher than the target temperature by 1° C. and the lower-limit set temperature is set at a value lower than the target temperature by 1° C.

Further, by a thermistor 28*b*B as the temperature detecting means contacted to the non-sheet-passing portion of the pressing roller 22, the surface temperature of the pressing roller 22 at the non-sheet-passing portion is monitored. Therefore, the thermistor 28*b*A is a temperature controlling thermistor for controlling the main heater 27*b*A and the sub-heater 27*b*B so that the surface temperature of the pressing roller 22 at the sheet-passing portion and hereinafter is referred to as a main thermistor 28*b*A. Further, the thermistor 28*b*B is a thermistor for monitoring the surface temperature of the pressing roller 22 at the non-sheet-passing portion and hereinafter is referred to as a sub-thermistor 28*b*B.

Further, inside the external heating rollers 31 and 32, halogen heaters 36A and 36B, which generate heat by energization and have rated power of, e.g., 300 W, are disposed over a substantially whole widthwise direction of the external heating roller 31, halogen heater 37A and 37B, which generate heat by energization and have rated power of, e.g., 500 W are disposed over a substantially whole widthwise direction of the external heating roller 32, respectively. That is, inside the external heating roller (upstream roller) 31, the halogen heaters (upstream heaters) 36A and 36B each having the rated power of 300 W are disposed. Further, inside the external heating roller (downstream roller) 32, the halogen heaters (downstream heaters) 37A and 37B each having the rated power of 500 W are disposed. Thus, total rated power of the upstream heaters 36A and 36B is 600 W, and total rated power of the downstream heaters 37A and 37B is 1000 W.

However, the halogen heaters 36A, 36B, 37A and 37B are, similarly as in the case of the halogen heaters 27*a*A and 27*a*B, made different in widthwise heat-generation distribution from each other. That is, the halogen heaters 36A and 37A have the heat-generation distribution as shown in FIG. 14, and the halogen heaters 36B and 37B have the heat-generation distribution as shown in FIG. 15. Hereinafter, the halogen heater 36A is referred to as a upstream main heater 36A, the halogen heater 37A is referred to as a downstream main heater 37A, and the halogen heater 36B is referred to as a upstream sub-heater 36B, and the halogen heater 37B is referred to as a downstream sub-heater 37B. In this embodiment, a total heat-generation amount of the upstream main heater 36A and the upstream sub-heater 36B is made smaller than that of the downstream main heater 37A and the downstream sub-heater 37B. Incidentally, of the outer peripheral surface of the belt member 23, a portion corresponding to the sheet-passing portion is a sheet-passing portion corresponding portion, and a portion corresponding to the non-sheet-passing portion is a non-sheet-passing portion corresponding portion.

Further, the surface temperature of the belt member 23 is detected by thermistors 38A and 39A as a temperature detecting means contacted to the sheet-passing portion corresponding portion of the belt member 23 in the upstream area D1 and the downstream area D2, respectively. The surface temperature of the belt member 23 is controlled at the predetermined target temperature of, e.g., 220° C. by turning on and off the main heaters 36A and 37A and the sub-heaters 36B and 37B by the CPU 29A. This control is also effected similarly as in First Embodiment so that the upper-limit set temperature is set at a value higher than the target temperature by 1° C. and the lower-limit set temperature is set at a value lower than the target temperature by 1° C.

Further, by thermistors 38B and 39B as the temperature detecting means contacted to the non-sheet-passing portion corresponding portion of the belt member 23 in the upstream area D1 and the downstream area D2, the surface temperature of the belt member 23 is monitored. Therefore, the thermistors 38A and 39A are temperature controlling thermistors for controlling the main heaters 36A and 37A and the sub-heaters 36B and 37B so that the surface temperature of the belt member 23 at the sheet-passing portion corresponding portion in the upstream area D1 and the downstream area D2. Hereinafter, the thermistors 38A and 39A are referred to as main thermistors 38A and 39A. Further, the thermistors 38B and 39B are thermistors for monitoring the surface temperature of the belt member 23 at the non-sheet-passing portion corresponding portion in the upstream area D1 and the downstream area D2, respectively, and are hereinafter referred to as sub-thermistors 38B and 39B.

Further, in this embodiment, in the case where the respective main heaters 27*a*A, 27*b*A, 36A and 37A and the respective sub-heaters 27*a*B, 27*b*B, 36B and 37B are simultaneously turned on in pairs (two heaters) in the associated one of the rollers, the resultant heat-generation amounts s with respect to the roller widthwise direction are designed to be substantially uniform. Further, in this embodiment, depending on the detected temperature of at least one sub-thermistor selected from the sub-thermistors 28*a*B, 28*b*B, 38B and 39B. Incidentally, the control of the respective heaters by the respective thermistors as described above is summarized in a block diagram shown in FIG. 16.

Next, control relating to the countermeasure against the non-sheet-passing-portion temperature rise in this embodiment will be described. In this embodiment, during the sheet passing of the small-sized recording material through the fixing device 20A, by lowering ON-ratios of the sub-heaters 27*a*B, 27*b*B, 36B and 37B in the respective roller and the belt, the temperature rise of the rollers at the non-sheet-passing portion and of the belt at the non-sheet-passing portion corresponding portion are prevented. These ON-ratios of the sub-heaters show a ratio of turning-on of the sub-heater to turning-on of the main heater during the turning-on of the heaters. That is, the ON-ratios show a ratio (operational ratio) of a time of energization to the sub-heater to a time of energization to the main heater. Further, these ON-ratios are changed, depending on recording-material information, the detected temperature of each of the sub-thermistors 28*a*B, 28*b*B, 38B and 39B in the rollers and the belt, or a combination of the recording-material information and the detected temperature of each sub-thermistor. Incidentally, examples of the recording-material information may include a basis weight (g/m$^2$), the type of paper (plain paper, coated paper, OHP sheet, embossed paper or the like), a sheet size (A3 size, A5 size or the like), and the like. Further, the change in ON-ratio is, in the case of the halogen heater, effected by using, e.g., time sharing control. The time sharing control is determined from, e.g., a relationship, between the ON-ratio and a time sharing control parameter, shown in Table 1.

TABLE 1

| ON-RATIO (%) | SUB-HEATER TIME SHARING CONTROL |
|---|---|
| 0 | ALL OFF |
| 20 | 1(SEC)ON + 4(SEC)OFF |
| 25 | 1(SEC)ON + 3(SEC)OFF |
| 33 | 1(SEC)ON + 2(SEC)OFF |
| 40 | 2(SEC)ON + 3(SEC)OFF |
| 50 | 2(SEC)ON + 2(SEC)OFF |
| 60 | 3(SEC)ON + 2(SEC)OFF |
| 66 | 2(SEC)ON + 1(SEC)OFF |
| 75 | 3(SEC)ON + 1(SEC)OFF |

TABLE 1-continued

| ON-RATIO (%) | SUB-HEATER TIME SHARING CONTROL |
|---|---|
| 80 | 4(SEC)ON + 1(SEC)OFF |
| 100 | ALL ON |

The case of ON-ratio=50% will be described as an example. When each of the detected temperatures of the respective main thermistors 28*a*A, 28*b*A, 38A and 39A for controlling the temperatures of the rollers and the belt is decreased and is lower than the target temperature, an associated pair of the respective main heaters 27*a*A, 27*b*A, 36A and 37A and the respective sub-heaters 27*a*B, 27*b*B, 36B and 37B is turned on. At this time, the main heater is continuously turned on ("ALL ON"), and the sub-heater is turned on for 2 seconds and then is turned off for 2 seconds ("2(SEC)ON+2 (SEC)OFF") and this operation is repeated.

Thus, by lowering the ON-ratio of the sub-heater having the heat-generation amount larger at widthwise end portions than that at a widthwise central portion, the heat-generation amount at the widthwise end portions is decreased and thus the non-sheet-passing-portion temperature rise can be reduced. On the other hand, at the widthwise central portion, the sheet-passing-portion temperature is kept at the predetermined temperature by continuously turning on the main heater having the heat-generation amount larger at the widthwise central portion than that at the widthwise end portions, so that the fixing proper is ensured. Incidentally, in the case where the detected temperature of the main thermistor is increased and is higher than the target temperature, the main heater and the sub-heater are turned off.

Incidentally, the respective main heaters and the respective sub-heaters are set to provide necessary values of power by being continuously turned on during the sheet passing of maximum-sized paper. Here, when the ON-ratio of the sub-heater is made small, there is a possibility of an electric power shortage. However, the ON-ratio of the sub-heater is decreased for the purpose of the countermeasure against the non-sheet-passing-portion temperature rise due to the sheet passing of the recording material smaller in size than that of the maximum-sized paper (particularly the recording material having a small recording material width with respect to the widthwise direction of the fixing device 20A). For this reason, with respect to the small-sized paper, the heat quantity taken from the fixing roller 21 or the pressing roller 22 is smaller than that with respect to the maximum-sized paper, i.e., the necessary power becomes small and therefore, even when the ON-ratio of the sub-heater is made small, the temperatures of the rollers and the belt at the sheet-passing portions are not lowered. However, when the ON-ratio of the sub-heater is extremely lowered, the temperatures of the rollers and the belt at the sheet-passing portions are decreased and lower than the target temperatures. For this reason, depending on the recording-material information (the basis weight, the sheet size, the type of paper), there is a need to set the ON-ratio of the sub-heater within a range in which the temperatures of the rollers and the belt are not decreased and are not lower than the target temperatures.

Here, the non-sheet-passing-portion temperature rise of the belt member 23 will be described. By the sheet passing of the small-sized paper, the heat is accumulated at the non-sheet-passing portion of the fixing roller 21, so that the non-sheet-passing-portion temperature rise occurs. Similarly, also at the non-sheet-passing portion corresponding portions of the belt member 23 and the external heating rollers 31 and 32, the heat is accumulated, so that the non-sheet-passing-portion temperature rise occurs.

At the sheet-passing portion corresponding portion, the heat is taken by the temperature-lowered sheet-passing portion of the fixing roller 21 and therefore the heat supplied thereto to be kept at the predetermined temperature. On the other hand, at the non-sheet-passing portion corresponding portion of the belt member 23, the fixing roller 21 becomes high temperature by the non-sheet-passing-portion temperature rise and therefore the heat is not taken therefrom and is accumulated, so that the non-sheet-passing-portion temperature rise occurs. Therefore, also with respect to the belt member 23 which is not contacted to the recording material, similarly as in the cases of the fixing member and the pressing member which are contacted to the recording material, the non-sheet-passing-portion temperature rise occurs although its level is small compared with those of the fixing member and the pressing member. Therefore, by preventing the occurrence of the non-sheet-passing-portion temperature rise of the belt member 23, it is also possible to reduce the degree of the non-sheet-passing-portion temperature rise of the fixing roller 21.

As a method for efficiently reduce the degree of the non-sheet-passing-portion temperature rise of the belt member 23 and for preventing the surface temperature non-uniformity during the sheet passing, it was turned out by study of the present inventors that the following method is suitable. That is, the ON-ratio of the sub-heater 36B in the upstream roller (hereinafter referred to as a first ON-ratio) is made larger than the ON-ratio of the sub-heater 37B in the downstream roller 32 (hereinafter referred to as a second ON-ratio). For example, the first ON-ratio is set at 75% and the second ON-ratio is set at 33%. Further, such ON-ratios of the sub-heaters 27*a*B, 27*b*B, 36B and 37B may preferably be changed depending on the paper (sheet) size.

According to this embodiment as described above, during the small-sized sheet passing, by satisfying (first ON-ratio)> (second ON-ratio), the degree of the non-sheet-passing-portion temperature rise is reduced efficiently and the lowering in minimum temperature of the fixing roller 21 is prevented, so that a good fixing property can be ensured. That is, in the case of (rated power of upstream roller 31)<(rated power of downstream roller 32), as the countermeasure against the non-sheet-passing-portion temperature rise during the small-sized sheet passing, there is a need to satisfy (first ON-ratio)> (second ON-ratio).

This is because in order to reduce the degree of the non-sheet-passing-portion temperature rise, the sub-heater ON-ratio of the external heating roller having the larger rated power is required to be made smaller than that of the external heating roller having the smaller rated power. However, in order to prevent the minimum temperature lowering, within the range in which the belt member temperature is not lower than the set temperature, there is a need to lower the sub-heater ON-ratio in the external heating roller.

Even in the case where (first ON-ratio)>(second ON-ratio) is satisfied, with respect to effective power which is the sum of the power of the main heater and the power of the sub-heater which are obtained by taking the ON-ratios into consideration, it is also necessary to maintain a relationship of (heating source power of upstream roller 31)<(heating source power of downstream roller 32). In the case where this relationship is not satisfied, as described above in First Embodiment, the temperature non-uniformity occurs at the belt member surface and is transferred onto the fixing roller surface, so that non-uniformity of the fixing roller surface temperature occurs.

Further, as in this embodiment, it would be considered that the reason why the lowest temperature is not lowered compared with the case of First Embodiment even when the sub-heater ON-ratio in the external heating roller is made small is as follows. That is, in the case of the small-sized paper, due to the small paper (sheet) width, compared with the recording material with the large paper width, the heat quantity taken from the fixing roller 21 per unit time is small. Further, the heat quantity accumulated and increased at the non-sheet-passing portion is transferred to the sheet-passing portion through the metal core. Therefore, even when the sub-heater ON-ratio is decreased to lower the power, the belt member temperature can be kept.

Further, in this embodiment, a constitution in which the sub-heater ON-ratio is changed depending on the size of the recording material is employed, but when the temperature at the non-sheet-passing portion is detected and the ON-ratio is changed in a stepwise manner, the reduction in degree of the non-sheet-passing-portion temperature rise and the prevention of the lowering in lowest temperature can be further improved. For example, during legal-paper passing under a condition described later, the first ON-ratio and the second ON-ratio are started from 100% and are, at the time when either the sub-thermistor 38B or the sub-thermistor 39B detects the temperature of 224° C., changed to 33% and 75%, respectively. Then, when either the sub-thermistor 38B or the sub-thermistor 39B detects the temperature of 226° C., e.g., the first ON-ratio is changed to 25% and the second ON-ratio is changed to 60%.

In this case, after the non-sheet-passing portion corresponding portion becomes a sufficiently high temperature, the sub-heater ON-ratio is made small and therefore the amount of the heat transferred from the non-sheet-passing portion to the sheet-passing portion is large, so that an effect of preventing the lowest temperature lowering becomes large. Further, the sub-heater ON-ratio can be made further small, so that the effect of preventing the non-sheet-passing-portion temperature rise becomes large.

Further, in First Embodiment described above, the description that the relationship of (rated power of downstream heater 37)≥(rated power of upstream heater 36)×1.2 is suitable from the viewpoint of energy saving is made, but correspondingly to this case, an amount corresponding to the power ratio may preferably be reflected in the sub-heater ON-ratio. Therefore, it is suitable to satisfy (heating source ON-ratio of at least one of downstream heaters 37A and 37B)×1.2≤(heating source ON-ratio of at least one of upstream heaters 36A and 36B).

Further, in this embodiment, the halogen heater is employed as the heating source, and therefore the term "ON-ratio" is used. However, in the case where a planar heat generating element prepared by applying a heat-generating resistor onto a planar base material is used as the heating source, the term "energization ratio" may also be used.

Further, in this embodiment, in the case where the main heater and the sub-heater were turned on simultaneously, the heaters designed to provide substantially uniform heat-generation amounts with respect to the longitudinal direction were employed. However, the heat-generation amounts are not necessarily required to be substantially uniform. For example, in the case where an amount of heat dissipation from the roller end portions is large, a similar effect is achieved even when the main heater and the sub-heater which can provide the large heat-generation amount at the roller end portions are employed.

<Confirmation of Effect of Second Embodiment>

An experiment for confirming the effect of this embodiment as described above will be explained. In this experiment, for comparison with this embodiment, Comparative Embodiments 4 to 5 different in ON-ratio of the upstream sub-heater 36B and the downstream sub-heater 37B were prepared. Further, in either case, as described above in Second Embodiment, the rated power of each of the upstream heaters 36A and 36B is 300 W and the total rated power of the upstream heaters 36A and 36B is 600 W, and the rated power of each of the downstream heaters 37A and 37B is 500 W and the total rated power of the downstream heaters 37A and 37B is 1000 W.

Incidentally, in the experiment, as the small-sized paper, sheets of legal (LGL) paper (width: 215.9 mm, length: 355.6 mm) having a basis weight of 300 g/m$^2$ were continuously passed, with portrait orientation at the speed of about 67 ppm, through the fixing device 20A having a maximum sheet passable width of 297 mm (A4 landscape width). As the experimental condition, the condition for the legal paper having a small width and a longer length is severe condition since the non-sheet-passing-portion temperature rise is liable to occur.

Further, with respect to the fixing roller 21 and the pressing roller 22, the ON-ratios of the sub-heaters 27*a*B and 27*b*B were set at 50%. Further, the non-sheet-passing-portion temperatures are detected by the sub-thermistors 28*a*B, 28*b*B, 38B and 39B but the upper-limit temperature at the non-sheet-passing portion is determined in consideration of the heat resistance property of the fixing-device members such as the elastic layer and the parting layer. In the experiment, as detected values by the thermistors, the surface temperatures were set at 220° C. for the fixing roller 21, at 230° C. in the contact areas D1 and D2 and at 240° C. for the external heating rollers 31 and 32. Incidentally, the surface temperatures of the external heating rollers 31 and 32 (upstream roller 31 and downstream roller 32) were measured by attaching the thermistor to each of the rollers 31 and 32.

Comparative Embodiment 4

First, as Comparative Embodiment 4, the experiment was conducted with the first ON-ratio of the upstream sub-heater 36B of 75% and the second ON-ratio of the downstream sub-heater 37B of 75%. In this case, the lowest temperature of the fixing roller 21 was T2 (180° C., FIG. 10) and the fixing property on the recording material was of no problem, i.e., was good. Further, at the time corresponding to the temperature T2, the detected temperature in the upstream area D1 by the main thermistor 38A was 220° C., so that the belt member 23 kept its set temperature.

In this case, in the steady state of the continuous sheet passing, the non-sheet-passing-portion temperatures were 224° C. for the fixing roller 21, 234° C. in the upstream area D1 and 245° C. for the downstream roller 32, so that a problem such that the non-sheet-passing-portion temperatures exceeded the upper-limit temperatures. The non-sheet-passing-portion temperature of the upstream roller 31 was 238° C. which was not more than the upper-limit temperature, thus being satisfactory. That is, in Comparative Embodiment 4, it was found that there is a possibility that deterioration of the members is caused by the non-sheet-passing-portion temperature rise for the fixing roller 21, the belt member 23 and the downstream roller 32. Therefore, there is a need to further lower the ON-ratio.

Comparative Embodiment 5

Next, as Comparative Embodiment 5, the experiment was conducted with the first ON-ratio of 50% and the second ON-ratio of 50%. In this case, in the steady state of the continuous sheet passing, the non-sheet-passing-portion temperatures were 218° C. for the fixing roller 21 and 228° C. in the upstream area D1 and when compared with Comparative Embodiment 4, the reduction in degree of the non-sheet-passing-portion temperature rise was improved for the fixing roller 21 and the belt member 23 and the non-sheet-passing-portion temperatures were not more than the upper-limit temperatures, i.e., were satisfactory. However, with respect to the downstream roller 32, the non-sheet-passing-portion temperature was 241° C. which still exceeded the upper-limit temperature. On the other hand, with respect to the upstream roller 31, the non-sheet-passing-portion temperature was 234° C. which was not more than the upper-limit temperature, i.e., was satisfactory. This is because the rated power (500 W) of the sub-heater 37B in the downstream roller 32 is larger than the rated power (300 W) of the sub-heater 36B in the upstream roller 31. That is, even when the ON-ratios of the sub-heaters 36B and 37B are evenly lowered, compared with the prevention of the non-sheet-passing-portion temperature rise of the belt member 23, there is no effect on the prevention of the non-sheet-passing-portion temperature rise of the downstream roller 32.

Further, the lowest temperature of the fixing roller 21 was T5 (175° C.) which was lower than T2 (180° C., FIG. 10), so that the fixing property on the recording material was worsened. The detected temperature in the upstream area D1 by the main thermistor 38A when the lowest temperature of the fixing roller 21 was T5 was 210° C. That is, by the lowering in external heating property due to the phenomenon that the temperature of the belt member 23 was decreased and was lower than the target temperature, the lowest temperature of the fixing roller 21 was lowered.

Therefore, in order to prevent the lowering in the lowest temperature, there is a need to increase the amount of heat supplied from the belt member 23 to the sheet-passing portion by increasing the ON-ratio of either the sub-heater 36B or the sub-heater 37B. Further, in order to improve the reduction in degree of the non-sheet-passing-portion temperature rise of the downstream roller 32, there is a need to lower the ON-ratio (second ON-ratio) of the sub-heater 37B. Therefore, there is a need to increase the first ON-ratio and to decrease the second ON-ratio.

Embodiment 2

Next, Embodiment 2 satisfying Second Embodiment will be described. In this embodiment, the first ON-ratio was 75% and the second ON-ratio was 33%. The CPU 29A sets, in the case where the paper having the length of 212.9 mm or less with respect to the rotational axis direction of the fixing roller 21 is used, the first ON-ratio at 75% and the second ON-ratio at 33%. On the other hand, in the case where the paper having the length which is longer than 212.9 mm is used, the CPU 29A sets the first ON-ratio at 100% and the second ON-ratio at 100%.

In this embodiment, in the case where the small-sized paper is passed, in the steady state of the continuous sheet passing, the respective temperatures were not more than the upper-limit temperatures, i.e., were satisfactory. That is, the non-sheet-passing-portion temperature of the fixing roller 21 was 218° C., the detected temperature in the upstream area D1 by the sub-thermistor 38B was 228° C., the non-sheet-passing-portion temperature of the downstream roller 32 was 238° C., and the non-sheet-passing-portion temperature of the upstream roller 31 was 238° C. At this time, the lowest temperature of the fixing roller 21 was T2 (180° C., FIG. 10) and the fixing property on the recording material was of no problem, i.e., was good. Further, at the time corresponding to the temperature T2, the detected temperature in the upstream area D1 by the main thermistor 38A was 220° C., so that the set temperature was kept. Therefore, by setting the ON-ratios so that (first ON-ratio)>(second ON-ratio) was satisfied, it is possible to compatibly realize the reduction in degree of the non-sheet-passing-portion temperature rise and the prevention of the lowering in the lowest temperature.

As described above, according to the present invention, the values of the power supplied to the respective heating means so that the maximum of the power supplied to the first heating means is smaller than the maximum of the power supplied to the second heating means, and therefore it is possible to increase the time of energization to the first heating means. As a result, the temperature non-uniformity at the belt member surface can be suppressed and the image heating member is heated in the state in which the temperature non-uniformity is suppressed, so that a degree of the occurrence of the image heating non-uniformity can be reduced.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 136200/2010 filed Jun. 15, 2010, which is hereby incorporated by reference.

What is claimed is:

1. An image heating device comprising:

a rotatable image heating member configured to heat an image on a recording material;

a pressing member configured to press said image heating member to form a nip in which the recording material is to be nip conveyed;

a belt member configured to heat said image heating member in contact with said image heating member;

a first belt heating member configured to heat said belt member while pressing said belt against said image heating member;

a second belt heating member, provided downstream of said first belt heating member with respect to a rotational direction of said image heating member, configured to heat said belt member while pressing said belt member against said image heating member;

first heating means for heating said first belt heating member by energization;

second heating means for heating said second belt heating member by energization, wherein each of said first heating means and said second heating means is supplied with power so that a maximum of the power supplied to said first heating means is smaller than that of the power supplied to said second heating means;

a first temperature detecting member configured to detect a temperature of said belt member in an area in which said first belt heating member contacts said belt member;

a second temperature detecting member configured to detect the temperature of said belt member in an area in which said second belt heating member contacts said belt member;

control means for controlling the energization to said first heating means so that a detected temperature by said first temperature detecting member is a first target temperature and for controlling the energization to said second heating means so that a detected temperature by said second temperature detecting member is a second target temperature;

third heating means, provided in said image heating member, for heating said image heating member; and a third temperature detecting member configured to detect a temperature of said image heating member, wherein said control means controls energization to said third heating means so that a detected temperature by said third temperature detecting member is a third target temperature, and wherein the first target temperature and the second target temperature are higher than the third target temperature and are the same temperature.

2. An image heating device according to claim 1, wherein each of said first heating means and said second heating means includes a main heater and a sub heater, wherein said main heater has a heat generation amount, at a position corresponding to a passing area through which a recording material having a predetermined size passes in the nip, which is larger than that at a position corresponding to an outside area deviated from the passing area in a widthwise direction, wherein said sub heater has a heat generation amount, at a position corresponding to the passing area, which is smaller than that at a position corresponding to the outside area, and wherein a total heat generation amount of said main heater and said sub heater of said first heating means is smaller than that of said second heating means.

3. An image heating device according to claim 2, wherein a ratio of a time of energization to said sub heater of said first heating means to a time of energization to said main heater of said first heating means is smaller than that of said second heating means.

4. An image forming apparatus comprising:

an image forming portion for forming an image on a recording material; and an image heating device according to claim 1.

5. An image heating apparatus comprising:

first and second rotatable members configured heat a toner image on a recording material at a nip portion therebetween;

an endless belt configured to heat said first rotatable member by contacting with an outer surface of said first rotatable member;

a first roller provided in said endless belt and configured to (i) press said endless belt toward said first rotatable member and (ii) heat said endless belt;

a second roller provided in said endless belt at a position downstream of said first roller with respect to a rotational direction of said first rotatable member and configured to (i) press said endless belt toward said first rotatable member and (ii) heat said endless belt;

a first heater provided in said first roller and configured to heat said first roller; and a second heater provided in said second roller and configured to heat said second roller, wherein the rating power of said second heater is larger than that of said first heater.

6. An apparatus according to claim 5, wherein the rating power of said second heater is not less than 1.2 times the rating power of said first heater.

7. An apparatus according to claim 5, wherein said first heater is a halogen heater, and said second heater is a halogen heater.

8. An apparatus according to claim 5, wherein a first target temperature for operating said first heater is substantially the same as a second target temperature for operating said second heater.

9. An apparatus according to claim 8, further comprising a third heater provided in said first rotatable member and configured to heat said first rotatable member, wherein the first target temperature and the second target temperature are higher than a third target temperature for operating said third heater.

10. An apparatus according to claim 9, wherein said third heater includes a plurality of heaters.

11. An apparatus according to claim 10, wherein each of said heaters of said third heater is a halogen heater.

12. An apparatus according to claim 9, wherein said first rotatable member is a roller.

13. An apparatus according to claim 5, wherein said first heater includes a plurality of heaters, said second heater includes a plurality of heaters, and wherein the sum of the rating power of the heaters of said second heater is larger than the sum of the rating power of the heaters of said first heater.

14. An apparatus according to claim 13, wherein the sum of the rating power of the heaters of said second heater is not less than 1.2 times the sum of the rating power of the heaters of said first heater.

15. An apparatus according to claim 13, wherein each of said heaters of said first heater is a halogen heater, and each of said heaters of said second heater is a halogen heater.

16. An apparatus according to claim 13, wherein a first target temperature for operating said heaters of said first heater is substantially the same as a second target temperature for operating said heaters of said second heater.

17. An apparatus according to claim 16, further comprising a third heater provided in said first rotatable member and configured to heat said first rotatable member, wherein the first target temperature and the second target temperature are higher than a third target temperature for operating said third heater.

18. An apparatus according to claim 17, wherein said third heater includes a plurality of heaters.

19. An apparatus according to claim 18, wherein each of said heaters of said third heater is a halogen heater.

20. An apparatus according to claim 17, wherein said first rotatable member is a roller.

* * * * *